US010743742B2

(12) United States Patent
Buesing et al.

(10) Patent No.: US 10,743,742 B2
(45) Date of Patent: Aug. 18, 2020

(54) DISHWASHER

(71) Applicant: Samsung Electronics Co., Ltd., Suwon-si, Gyeonggi-do (KR)

(72) Inventors: Johannes Buesing, Suwon-si (KR); Chang Wook Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/351,891

(22) Filed: Mar. 13, 2019

(65) Prior Publication Data

US 2019/0343368 A1 Nov. 14, 2019

(30) Foreign Application Priority Data

May 10, 2018 (KR) ..... 10-2018-0053796

(51) Int. Cl.
*A47L 15/50* (2006.01)
*A47L 15/28* (2006.01)

(52) U.S. Cl.
CPC ..... *A47L 15/504* (2013.01); *A47L 15/28* (2013.01); *A47L 15/502* (2013.01)

(58) Field of Classification Search
CPC ..... A47L 15/504; A47L 15/28; A47L 15/502; A47L 15/26; A47L 15/30; A47L 15/34;
(Continued)

(56) References Cited

U.S. PATENT DOCUMENTS 3,752,322 A * 8/1973 Fiocca ..... A47L 15/503 211/41.8
4,046,261 A * 9/1977 Yake ..... A47L 15/503 211/41.8
(Continued)

FOREIGN PATENT DOCUMENTS

CN 106343937 1/2017
DE 102008062761 3/2010
(Continued)

OTHER PUBLICATIONS

International Search Report and Written Opinion of the International Searching Authority dated Jul. 15, 2019 in International Patent Application No. PCT/KR2019/002997.
(Continued)

*Primary Examiner* — Jennifer E. Novosad
(74) *Attorney, Agent, or Firm* — Staas & Halsey LLP

(57) ABSTRACT

A dishwasher having a structure so that a height of a rack assembly may be adjusted includes: a main body; a tub provided inside the main body and having an opening; a door provided to open or close the opening of the tub; and a rack assembly disposed inside the tub to accommodate tableware, wherein the rack assembly includes: a frame including a loading portion on which the tableware is placed, the loading portion including a fixing plate and a lifting plate provided to be movable up and down; an operating member provided to be capable of adjusting a height of the lifting plate; and a lifting induction member provided to connect the operating member and the lifting plate, and wherein the lifting plate moves in conjunction with the lifting induction member by the operation of the operating member.

16 Claims, 22 Drawing Sheets

(58) Field of Classification Search
CPC ..... A47L 15/50; A47L 15/503; A47L 15/505; A47L 15/506; A47L 15/507; A47L 15/508
USPC ..... 211/41.8, 41.9, 41.5, 41.6; D32/3; 134/85–87, 59, 137
See application file for complete search history.

(56) References Cited

U.S. PATENT DOCUMENTS 4,917,248 A * 4/1990 Friskney ..... A47L 15/503 211/184
5,205,419 A * 4/1993 Purtilo ..... A47L 15/503 134/200
5,480,035 A * 1/1996 Smith ..... A47L 15/503 211/168
5,601,195 A * 2/1997 Finola ..... A47L 15/503 211/41.8
6,325,220 B1 * 12/2001 Malmstrom ..... A47L 15/503 211/41.1
6,571,965 B1 * 6/2003 Beck ..... A47L 15/503 211/41.8
6,848,585 B2 * 2/2005 VanLandingham ... A47L 15/504 211/41.8
7,231,929 B2 * 6/2007 Landsiedel ..... A47L 15/14 134/135
7,931,155 B2 * 4/2011 Bastuji ..... A47L 15/503 134/56 D
8,042,559 B2 * 10/2011 Choi ..... B08B 3/04 134/137
8,104,628 B2 * 1/2012 Kim ..... A47L 15/503 211/171
8,191,560 B2 6/2012 Mallory et al.
8,408,403 B2 * 4/2013 Hedstrom ..... A47L 15/505 211/181.1
8,646,620 B2 * 2/2014 Klump ..... A47L 15/50 211/41.8
8,701,898 B2 * 4/2014 Chai ..... A47L 15/503 211/150
8,807,352 B2 * 8/2014 Haltmayer ..... A47L 15/50 211/41.8
8,925,742 B1 * 1/2015 Chitayat ..... A47L 19/04 211/132.1
9,033,432 B2 * 5/2015 Kilic ..... A47L 15/503 312/228.1
9,107,552 B2 * 8/2015 Micek ..... A47L 19/04
9,265,404 B2 * 2/2016 Fey ..... A47L 15/503
9,629,515 B2 * 4/2017 Chan ..... A47L 15/503
9,962,063 B2 * 5/2018 Beshears, Jr. ..... A47L 15/508
10,285,566 B2 * 5/2019 Fey ..... A47L 15/503
10,405,731 B2 * 9/2019 Harr ..... A47L 15/503
10,426,315 B2 * 10/2019 Pugh ..... A47L 15/507
10,463,226 B2 * 11/2019 Mesa ..... A47L 15/505
2002/0148494 A1 * 10/2002 Smith ..... A47L 15/503 134/201
2007/0039904 A1 * 2/2007 Purushothaman .... A47L 15/503 211/41.8
2007/0119801 A1 * 5/2007 Miele ..... A47L 15/502 211/70.7
2007/0247039 A1 * 10/2007 Anderson ..... A47L 15/0084 312/228.1
2008/0083678 A1 * 4/2008 Graute ..... A47L 15/503 211/41.8
2008/0302740 A1 * 12/2008 Moser ..... A47L 15/503 211/41.8
2009/0090681 A1 * 4/2009 Graute ..... A47L 15/505 211/41.9
2009/0120883 A1 * 5/2009 Jadhav ..... A47L 15/503 211/41.9
2012/0056519 A1 * 3/2012 Woo ..... A47L 15/503 312/228.1
2013/0299438 A1 * 11/2013 McDaniel ..... A47L 15/505 211/41.9
2015/0053237 A1 * 2/2015 Lee ..... A47L 15/4295 134/18
2016/0037997 A1 * 2/2016 Mesa ..... A47L 15/503 134/166 R
2018/0206700 A1 * 7/2018 Ko et al. ..... A47L 15/504 211/41.9
2018/0206701 A1 * 7/2018 Ko ..... A47L 15/502
2019/0343368 A1 * 11/2019 Buesing ..... A47L 15/28

FOREIGN PATENT DOCUMENTS

JP 4280635 6/2009
KR 20-1989-0002448 4/1989
KR 10-2014-0064121 5/2014
KR 10-2017-0021641 2/2017
WO 2017/030355 2/2017
WO 2019/192910 10/2019

OTHER PUBLICATIONS

Extended European Search Report dated Nov. 22, 2019 in European Patent Application No. 19164510.0.

* cited by examiner 161, 162: 160

161, 162 : 160

161, 162: 160

DISHWASHER

CROSS-REFERENCE TO RELATED APPLICATIONS

This application is based on and claims priority under 35 U.S.C. § 119 to Korean Patent Application No. 10-2018-0053796, filed on May 10, 2018 in the Korean Intellectual Property Office, the disclosure of which is incorporated by reference herein in its entirety.

BACKGROUND

1. Field

The present disclosure relates to a dishwasher, and more particularly, to a dishwasher having an improved structure so that a height of a rack assembly may be adjusted.

2. Description of the Related Art

A dishwasher is a device that automatically cleans food waste left on tableware using a detergent and washing water.

The dishwasher includes a main body, a tub disposed inside the main body, a tableware accommodating assembly disposed inside the tub to accommodate tableware, and an injection unit provided to inject washing water to the tableware accommodating assembly.

The tableware accommodating assembly includes a basket in which relatively bulky tableware is accommodated, and a rack assembly in which a relatively small volume of tableware such as cutlery is accommodated.

In general, the rack assembly of the dishwasher is difficult to adjust in height, and even if it is possible to adjust the height of the rack assembly, the height of the rack assembly should be adjusted after the rack assembly is removed from the tub of the dishwasher. Therefore, a user is hassled and inconvenienced when using the dishwasher having the conventional rack assembly.

SUMMARY

It is an aspect of the present disclosure to provide a dishwasher having an improved structure to facilitate the height adjustment of a rack assembly.

It is an aspect of the present disclosure to provide a dishwasher having an improved structure to improve the space utilization of a tub.

It is an aspect of the present disclosure to provide a dishwasher having an improved structure to be easy to manufacture and to reduce manufacturing costs.

It is an aspect of the present disclosure to provide a dishwasher having an improved structure so that a rack assembly may smoothly slide along a guide rail.

Additional aspects will be set forth in part in the description which follows and, in part, will be apparent from the description, or may be learned by practice of the presented embodiments.

In accordance with an aspect of the present disclosure, a dishwasher may include: a main body; a tub provided inside the main body and having an opening; a door provided to open or close the opening of the tub; and a rack assembly disposed inside the tub to accommodate tableware, wherein the rack assembly may include: a frame including a loading portion on which the tableware is placed, the loading portion including a fixing plate and a lifting plate provided to be movable up and down; an operating member provided to be capable of adjusting a height of the lifting plate; and a lifting induction member provided to connect the operating member and the lifting plate, and wherein the lifting plate may move in conjunction with the lifting induction member by the operation of the operating member.

The lifting induction member may be rotatably coupled to the frame to be positioned between the fixing plate and the lifting plate.

The rack assembly may further include a link member connecting the lifting plate and the lifting induction member.

The lifting plate may include a guide slot provided to correspond to the link member, and an arm, which is movably coupled to the guide slot, may be formed at an end of the link member.

The guide slot may include a first end adjacent to the lifting induction member, and a second end positioned opposite the first end and above the first end.

The guide slot may further include a connection portion connecting the first end and the second end.

When the arm of the link member is positioned at the first end of the guide slot, the lifting plate may be lowered, and when the arm of the link member is positioned at the second end of the guide slot, the lifting plate may be raised.

The frame may further include at least one lifting induction member holder extending from the fixing plate toward the lifting plate to be coupled with the lifting induction member.

The operating member may be coupled to the lifting induction member to rotate with the lifting induction member.

The frame may further include a wall disposed along a periphery of the loading portion to have a height, and a rotation restricting rib, which restricts the rotation range of the operating member, may be formed on an inner surface of the wall facing the operating member.

The rotation restricting rib may include: a first rotation restricting rib provided to interfere with the operating member when the lifting plate is raised; and a second rotation restricting rib provided to interfere with the operating member when the lifting plate is lowered, and the second rotation restricting rib may be disposed to be spaced apart from the first rotation restricting rib.

In accordance with an aspect of the present disclosure, a dishwasher may include: a main body; a tub provided inside the main body; and a rack assembly disposed inside the tub to accommodate tableware, wherein the rack assembly may include: a frame including a loading portion on which the tableware is placed, the loading portion including a fixing plate and a lifting plate provided to be movable up and down; a first lifting induction member connected to a first end of the lifting plate to be rotatable; a second lifting induction member connected to a second end of the lifting plate to be rotatable; and an operating member provided to be capable of adjusting a height of at least one of the first end and the second end of the lifting plate.

The tub may include an opening, and the operating member may be provided to be adjacent to the opening of the tub.

The operating member may include: a first operating member coupled to the first lifting induction member to adjust the height of the first end of the lifting plate by rotating the first lifting induction member; and a second operating member coupled to the second lifting induction member to adjust the height of the second end of the lifting plate by rotating the second lifting induction member separately from the first operating member.

The rack assembly may further include: a first link member connecting the first end of the lifting plate and the first lifting induction member, and having an arm movably coupled to a first guide slot provided at the first end of the lifting plate; and a second link member connecting the second end of the lifting plate and the second lifting induction member, and having an arm movably coupled to a second guide slot provided at the second end of the lifting plate.

In accordance with an aspect of the present disclosure, a dishwasher may include: a main body; a tub provided inside the main body and having an opening; and a rack assembly disposed inside the tub to be capable of being withdrawn so that tableware is accommodated, wherein the rack assembly may include: a frame including a loading portion on which the tableware is placed, the loading portion including a fixing plate and a lifting plate provided to be movable up and down; a lifting induction member rotatably disposed to move in conjunction with the lifting plate; and an operating member provided to be adjacent to an opening of the tub to be capable of adjusting a height of the lifting plate, and wherein the height of the lifting plate may be adjustable when the rack assembly is positioned inside the tub.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
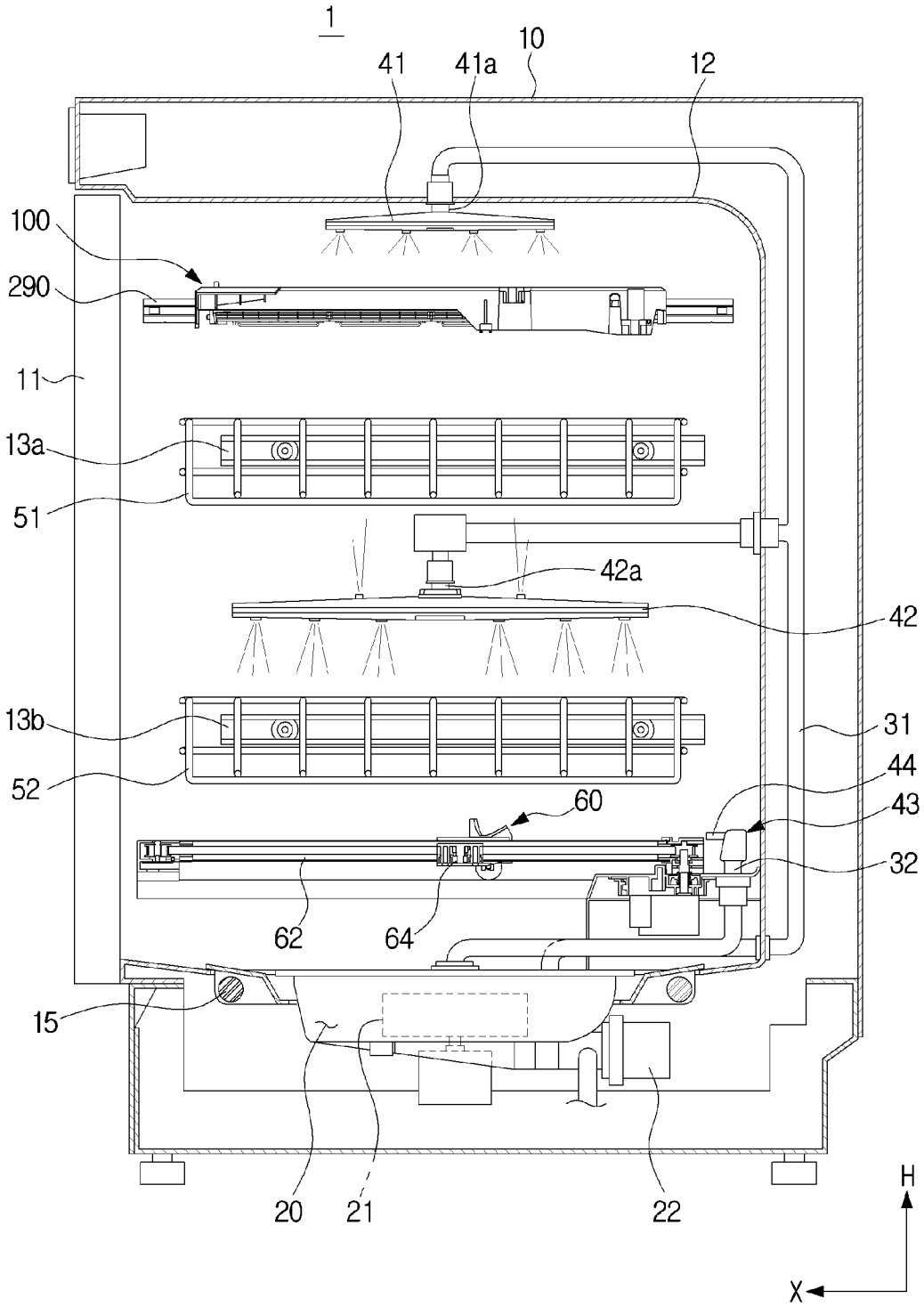
FIG. 1 is a sectional view of a dishwasher according to an embodiment of the present disclosure.

Reference will now be made in detail to the embodiments, examples of which are illustrated in the accompanying drawings, wherein like reference numerals refer to like elements throughout. The embodiments are described below to explain the disclosure by referring to the figures.

Hereinafter, embodiments of the present disclosure will be described in detail with reference to the accompanying drawings. In this specification, the terms "front," "rear," "upper," "lower," "left," and "right" are defined with reference to the drawings, and the shape and position of each component are not limited by these terms.

Hereinafter, tableware may be used as a concept including bowls, cups, cutlery, and various cooking utensils. An operating member may include an operating lever. A lifting induction member may include a lifting induction connector. A lifting induction member holder may include lifting induction connector holder. A link member may include a link connector.

Hereinafter, a first direction X refers to a direction in which a virtual line connecting an opening portion 12*a* of a tub 12 and a surface facing the opening portion 12*a* of the tub 12 is extended. A second direction Y refers to a direction different from the first direction X. The first direction X refers to the same direction as an axial direction X of a lifting induction member 140. For convenience of explanation, the first direction X is referred to as the front-rear direction of a dishwasher 1 and the second direction Y is referred to as the left-right direction of the dishwasher 1.

Figure 2:
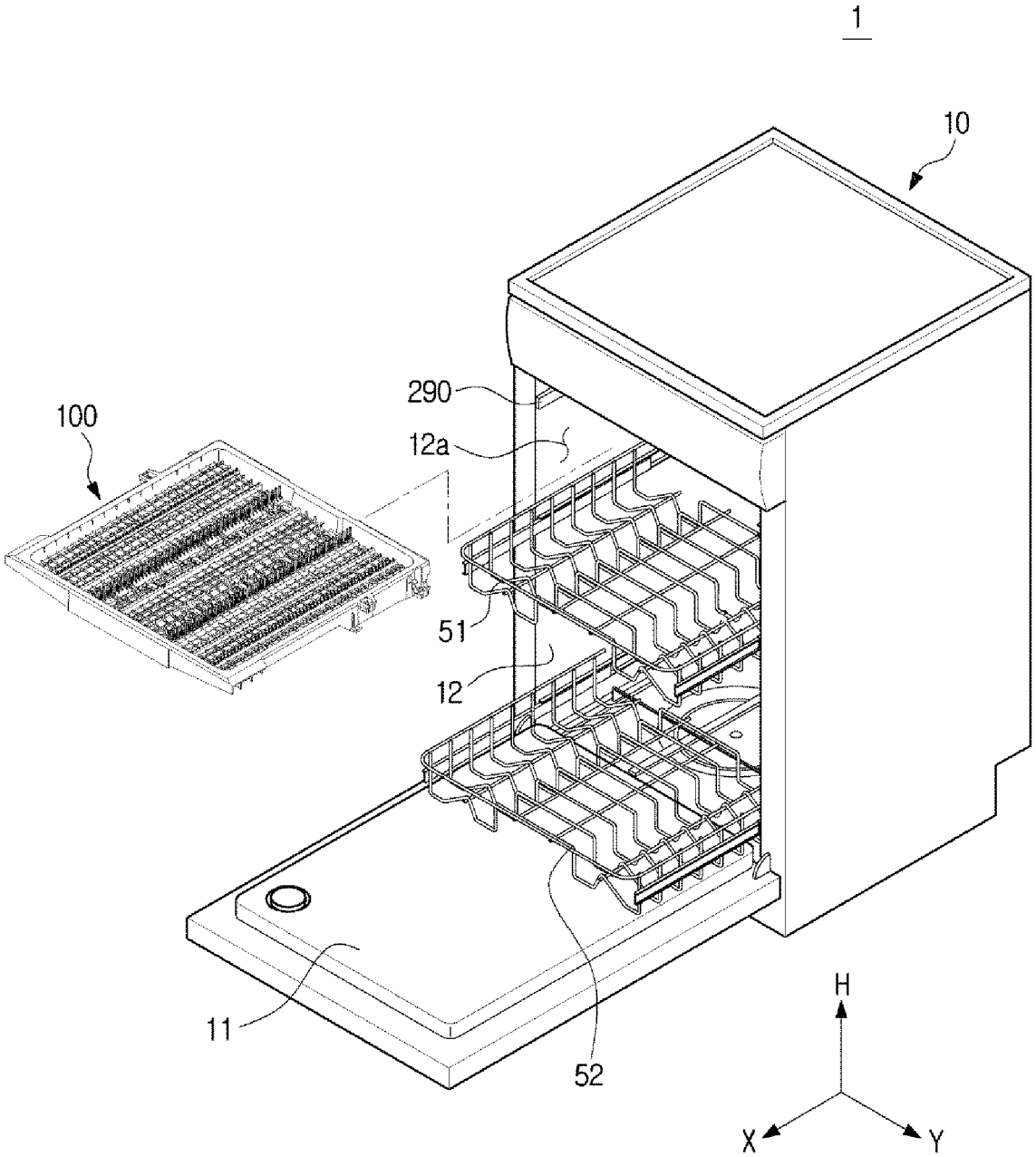
FIG. 2 is a perspective view of a dishwasher according to an embodiment of the present disclosure.

FIG. 1 is a sectional view of a dishwasher according to an embodiment of the present disclosure, and FIG. 2 is a perspective view of a dishwasher according to an embodiment of the present disclosure.

As illustrated in FIGS. 1 and 2, the dishwasher 1 may include a main body 10 forming an outer appearance.

The dishwasher 1 may further include the tub 12 provided inside the main body 10. The tub 12 may be provided in a substantially box shape. One surface of the tub 12 may be opened. That is, the tub 12 may have the opening portion 12*a*. As an example, a front surface of the tub 12 may be opened.

The dishwasher 1 may further include a door 11 provided to open or close the opening portion 12*a* of the tub 12. The door 11 may be mounted on the main body 10 to open or close the opening portion 12*a* of the tub 12. The door 11 may be rotatably mounted on the main body 10.

The dishwasher 1 may further include a tableware accommodating assembly provided inside the tub 12 to accommodate tableware.

The tableware accommodating assembly may include a plurality of baskets 51 and 52. The plurality of baskets 51 and 52 may accommodate relatively bulky tableware. However, the types of the tableware accommodated in the plurality of baskets 51 and 52 are not limited to the relatively bulky tableware. That is, not only the relatively bulky tableware, but also relatively small tableware may be accommodated in the plurality of baskets 51 and 52.

The plurality of baskets 51 and 52 may include the upper basket 51 positioned at an upper portion in a height direction H of the dishwasher 1, and the lower basket 52 positioned at a lower portion in the height direction H of the dishwasher 1. The upper basket 51 may be provided to be supported by an upper guide rack 13*a*, and the lower basket 52 may be provided to be supported by a lower guide rack 13*b*. The upper guide rack 13*a* and the lower guide rack 13*b* may be installed to an inner wall of the tub 12 to be slidable toward the opening portion 12*a* of the tub 12. As an example, the upper guide rack 13*a* and the lower guide rack 13*b* may be installed to the inner wall of the tub 12 to be slidable in the first direction X.

The tableware accommodating assembly may further include a rack assembly 100. The rack assembly 100 may be disposed inside the tub 12 to accommodate tableware. Specifically, the rack assembly 100 may be disposed inside the tub 12 to be withdrawable. The rack assembly 100 may accommodate a relatively small volume of tableware. The rack assembly 100 may accommodate cooking utensils such as a scoop, a knife and a fritter tender, and cutlery. In addition, a small cup, such as an espresso cup, may be accommodated in the rack assembly 100. However, the type of tableware accommodated in the rack assembly 100 is not limited to the above examples. The rack assembly 100 may be positioned above the plurality of baskets 51 and 52 in the height direction H of the dishwasher 1. In other words, the rack assembly 100 may be positioned at the uppermost portion of the tub 12 in the height direction H of the dishwasher 1. A guide rail 290 may be provided on the inner wall of the tub 12 to guide the withdrawal of the rack assembly 100.

Details of the rack assembly 100 will be described later.

The dishwasher 1 may further include a sump 20 for collecting and storing washing water. The sump 20 may be provided with a washing pump 21 to pump the stored water to a plurality of injection units 41, 42, and 43. The washing water pumped by the washing pump 21 may be supplied to the first injection unit 41 and the second injection unit 42, which will be described later, through a first supply pipe 31 or may be supplied to the third injection unit 43, which will be described later, through a second supply pipe 32.

The dishwasher 1 may further include a heater 15 disposed at a lower portion of the tub 12 to heat the washing water, and a drain pump 22 disposed at a lower portion of the tub 12 to drain the washing water.

The dishwasher 1 may further include the plurality of injection units 41, 42, and 43 configured to inject the washing water. The plurality of injection units 41, 42, and 43 may include the first injection unit 41 disposed above the upper basket 51 in the height direction H of the dishwasher 1, the second injection unit 42 disposed between the upper basket 51 and the lower basket 52 in the height direction H of the dishwasher 1, and the third injection unit 43 disposed below the lower basket 52 in the height direction H of the dishwasher 1. Specifically, the first injection unit 41 may be disposed above the rack assembly 100 in the height direction H of the dishwasher 1.

The first injection unit 41 may be provided to be rotatable about a rotation shaft 41*a*. The second injection unit 42 may be provided to be rotatable about a rotation shaft 42*a*.

The first injection unit 41 may inject the washing water toward the tableware accommodated in the rack assembly 100 and the upper basket 51, and the second injection unit 42 may inject the washing water toward the tableware accommodated in the upper basket 51 and the lower basket 52.

The third injection unit 43 may be provided to be fixed to one side of the tub 12, unlike the first injection unit 41 and the second injection unit 42. The third injection unit 43 injects the washing water in a substantially horizontal direction, and therefore the washing water injected from the third injection unit 43 may not directly go toward the tableware.

The third injection unit 43 may include nozzles 44 to inject the washing water. The nozzles 44 may be arranged in a line to be spaced apart from each other by a predetermined distance from one side to the opposite side of the tub 12.

The washing water injected in the substantially horizontal direction from the nozzles 44 of the third injection unit 43 may be redirected by a switching assembly 60 disposed inside the tub 12 and moved toward the tableware accommodated in the lower basket 52. The switching assembly 60 may be configured to be constrained to the guide rail 62 by a holder 64 and to be movable along the guide rail 62.

Figure 3:
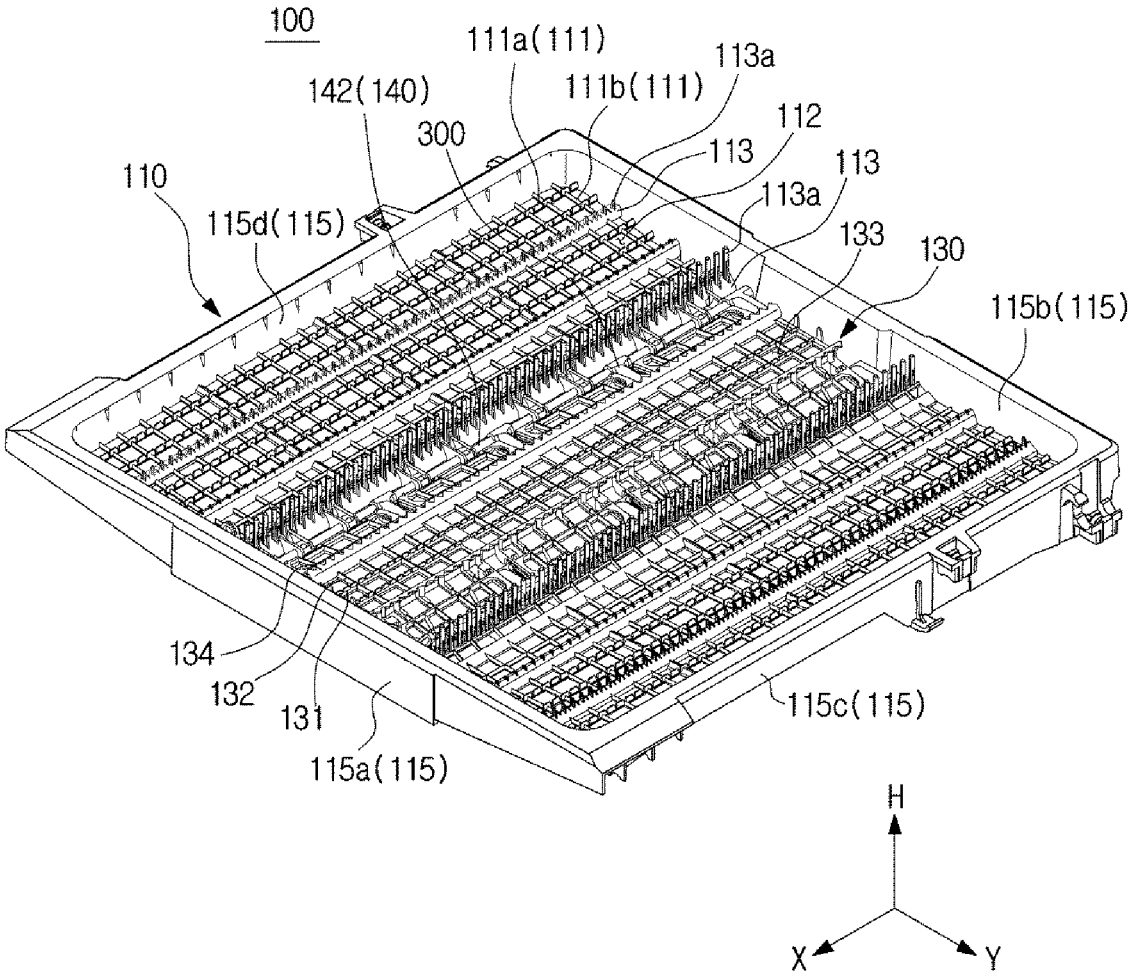
FIG. 3 is a perspective view of a rack assembly in a dishwasher according to an embodiment of the present disclosure.
Figure 4:
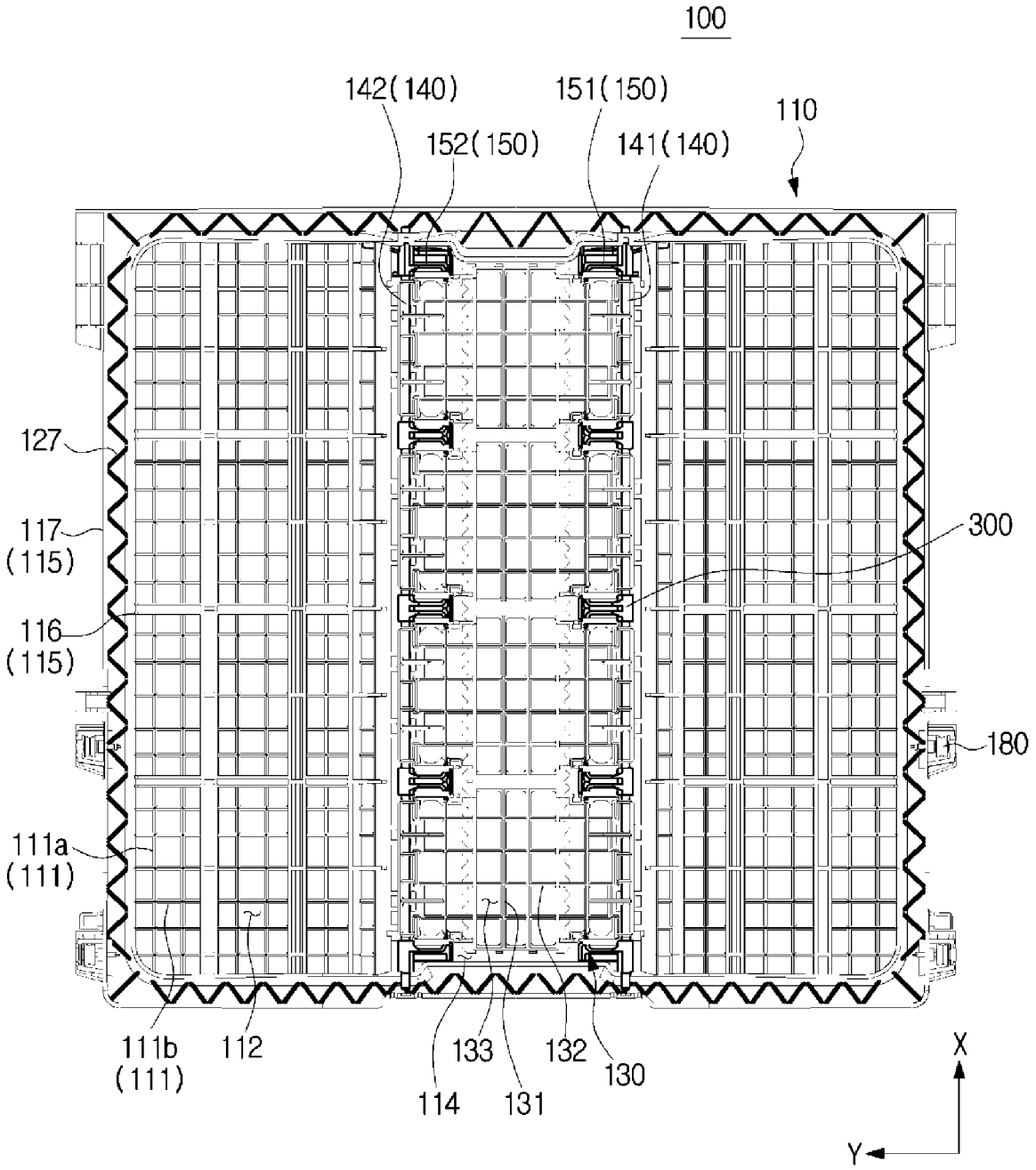
FIG. 4 is a view illustrating a reinforcing structure of a rack assembly in a dishwasher according to an embodiment of the present disclosure.
Figure 5:
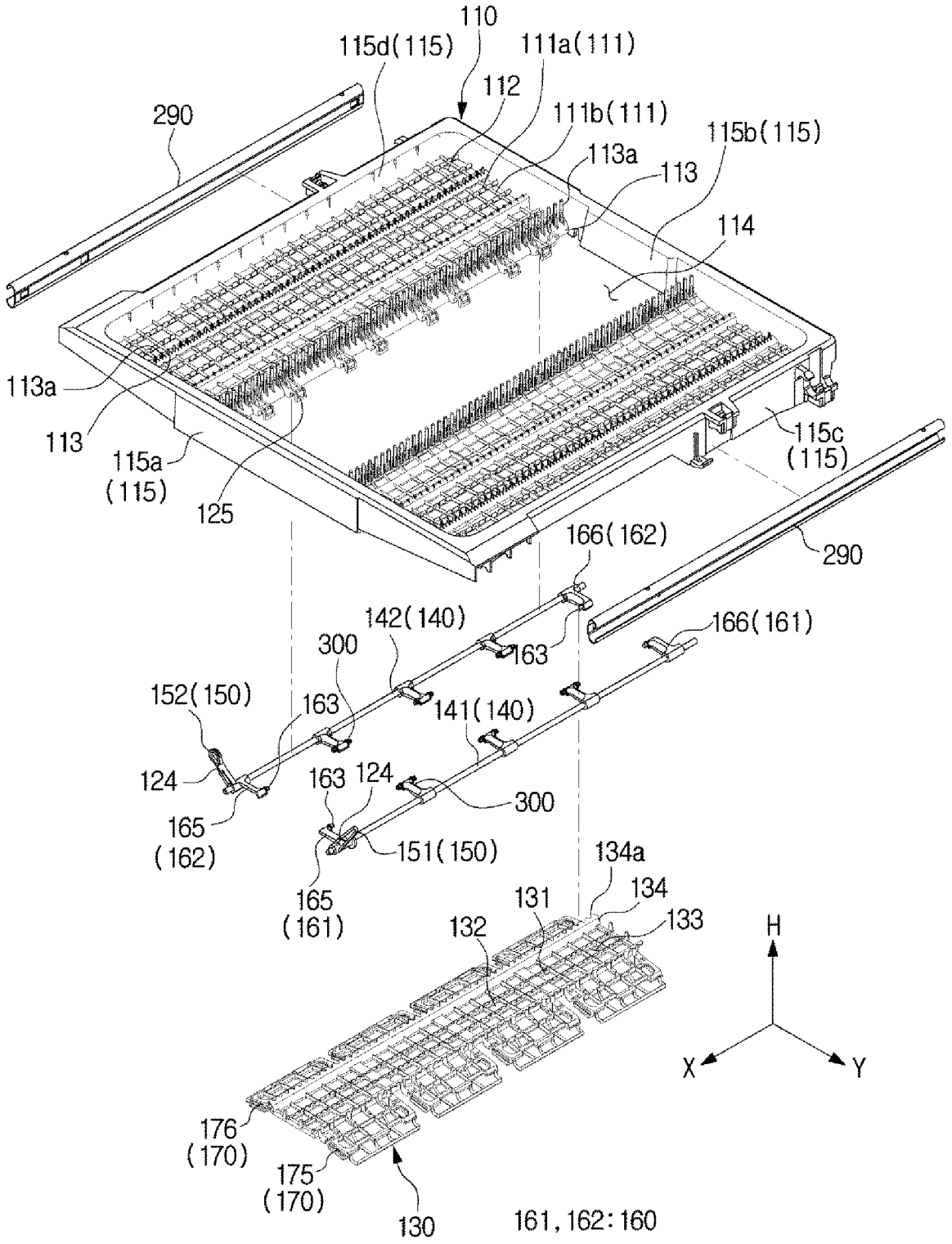
FIG. 5 is an exploded perspective view of a rack assembly in a dishwasher according to an embodiment of the present disclosure.
Figure 6:
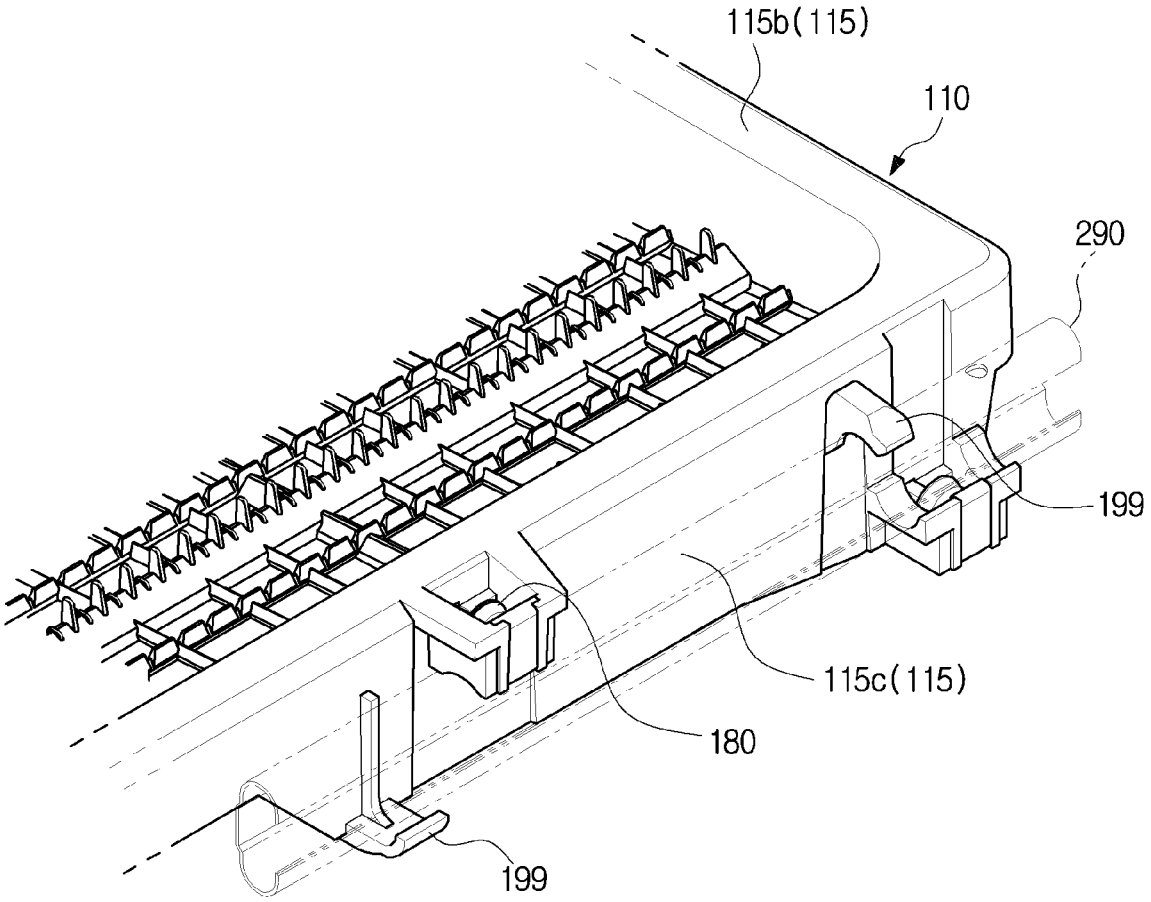
FIG. 6 is an enlarged view of one side of a rack assembly in a dishwasher according to an embodiment of the present disclosure.
Figure 7:
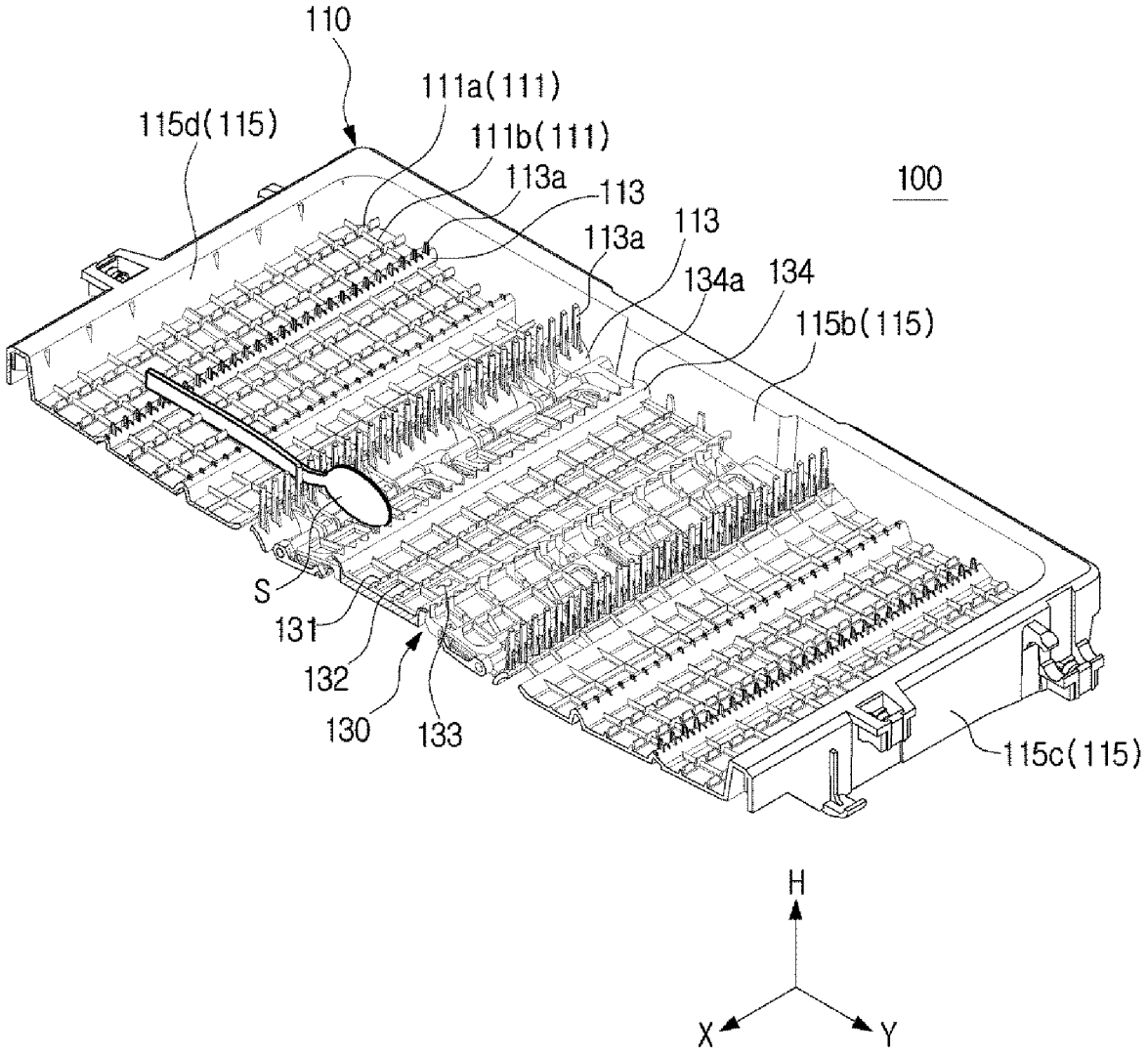
FIG. 7 is a view illustrating a state in which tableware is accommodated in a rack assembly in a dishwasher according to an embodiment of the present disclosure.

FIG. 3 is a perspective view of a rack assembly in a dishwasher according to an embodiment of the present disclosure. FIG. 4 is a view illustrating a reinforcing structure of a rack assembly in a dishwasher according to an embodiment of the present disclosure. FIG. 5 is an exploded perspective view of a rack assembly in a dishwasher according to an embodiment of the present disclosure. FIG. 6 is an enlarged view of one side of a rack assembly in a dishwasher according to an embodiment of the present disclosure. FIG. 7 is a view illustrating a state in which tableware is accommodated in a rack assembly in a dishwasher according to an embodiment of the present disclosure. FIG. 4 is a view illustrating a rear surface of the rack assembly 100. "S" in FIG. 7 refers to a spoon accommodated in the rack assembly 100. Reference numeral 199 in FIG. 6 refers to a rail holder. Reference numeral 150 denotes an operating member including a first operating member 151 and a second operating member 152.

As illustrated in FIGS. 3 to 7, the rack assembly 100 may include a frame 110 forming an outer appearance of the rack assembly 100.

The frame 110 may include a loading portion on which the tableware is placed. The loading portion may include a fixing plate 111 and a lifting plate 130 provided to be movable up and down. The lifting plate 130 may be provided to be adjustable in height. The lifting plate 130 may be disposed at a central portion of the frame 110 to be movable up and down. The tableware may be placed over the fixing plate 111 and the lifting plate 130 of the frame 110 as illustrated in FIG. 7.

The rack assembly 100 may further include the lifting induction member 140 provided to connect the first and second operating members 151 and 152 and the lifting plate 130. The lifting induction member 140 may be provided to be rotatable. As an example, the lifting induction member 140 may include a shaft. The lifting plate 130 may move in conjunction with the lifting induction member 140. The lifting induction member 140 may be rotatably coupled to the frame 110. The lifting induction member 140 may be coupled to the frame 110 to be positioned between the fixing plate 111 and the lifting plate 130. The lifting induction member 140 may extend toward the opening portion 12*a* of the tub 12. Specifically, the lifting induction member 140 may extend along the first direction X. The lifting induction member 140 may have a linear shape.

The rack assembly 100 may further include the first and second operating members 151 and 152 provided to be capable of adjusting a height of the lifting plate 130. The lifting plate 130 may move in conjunction with the lifting induction member 140 by the operation of the first and second operating members 151 and 152. The first and second operating members 151 and 152 may be provided to be adjacent to the opening portion 12*a* of the tub 12 to facilitate access by a user. Therefore, the user may easily adjust the height of the lifting plate 130 without needing to withdraw the rack assembly 100 from the tub 12.

The first and second operating members 151 and 152 may be coupled to the lifting induction member 140. Specifically, the first and second operating members 151 and 152 may be coupled to a first end of the lifting induction member 140 facing the opening portion 12*a* of the tub 12.

The rack assembly 100 may further include a link member 160 to connect the lifting plate 130 and the lifting induction member 140.

The rack assembly 100 may further include at least one connection member 300 to connect the lifting plate 130 and the lifting induction member 140 together with the link member 160. A plurality of the link member 160 may be provided. The at least one connection member 300 may be disposed between the link members 160 to connect the lifting plate 130 and the lifting induction member 140.

Hereinafter, each configuration will be described in detail.

The fixing plate 111 of the frame 110 may be formed with a plurality of holes 112 through which washing water may pass.

The fixing plate 111 may be formed by a plurality of ribs 111*a* and 111*b* intersecting with each other. That is, the fixing plate 111 may have a grill shape. The plurality of ribs 111*a* and 111*b* may include a plurality of the first ribs 111*a* extending in the first direction X and a plurality of the second ribs 111*b* extending in the second direction Y. However, it suffices that the plurality of first ribs 111*a* and the plurality of second ribs 111*b* may intersect with each other, and the extending directions of the plurality of first ribs 111*a* and the plurality of second ribs 111*b* are not limited to the above example. The plurality of first ribs 111*a* and the plurality of second ribs 111*b* may be orthogonal to each other.

The shape of the fixing plate 111 is not limited to the above example and may be variously changed. As an example, any shape is possible as long as the fixing plate 111 may support the tableware and have holes through which the washing water may pass.

The fixing plate 111 may be provided with a plurality of holders 113 so that the tableware may be held. The plurality of holders 113 prevent the tableware from being damaged by preventing the tableware from moving during the operation of the dishwasher 1. The plurality of holders 113 may be arranged to be spaced apart from each other in the second direction Y by a predetermined distance. Each of the plurality of holders 113 may include a plurality of holding ribs 113*a* arranged to be spaced apart from each other in the first direction X by a predetermined distance. However, the arranging direction of the plurality of holders 113 and the arranging direction of the plurality of holding ribs 113*a* are not limited to the above example and may be variously changed. The plurality of holding ribs 113*a* may be formed to protrude from the fixing plate 111. As illustrated in FIG. 7, the tableware is fixed to the fixing plate 111 by being sandwiched between the neighboring holding ribs 113*a*.

The frame 110 may further include an opening 114. The opening 114 may be formed at the central portion of the frame 110 so that the lifting plate 130 may be positioned. That is, the fixing plate 111 of the frame 110 may be divided into two regions around the opening 114. As an example, the fixing plate 111 of the frame 110 may be divided into a left side region and a right side region around the opening 114.

A plurality of holes 133 may be formed on the lifting plate 130 to allow the washing water to pass therethrough.

The lifting plate 130 may be formed by a plurality of ribs 131 and 132 intersecting with each other. That is, the lifting plate 130 may have a grill shape. The plurality of ribs 131 and 132 may include a plurality of the first ribs 131 extending in the first direction X and a plurality of the second ribs 132 extending in the second direction Y. However, it suffices that the plurality of first ribs 131 and the plurality of second ribs 132 may intersect with each other, and the extending directions of the plurality of first ribs 131 and the plurality of second ribs 132 are not limited to the above example. The plurality of first ribs 131 and the plurality of second ribs 132 may be orthogonal to each other.

The shape of the lifting plate 130 is not limited to the above example and may be variously changed. As an example, any shape is possible as long as the lifting plate 130 may support the tableware and have holes through which the washing water may pass.

The lifting plate 130 may be provided with a plurality of holders 134 so that the tableware may be held. The plurality of holders 134 prevent the tableware from being damaged by preventing the tableware from moving during the operation of the dishwasher 1. The plurality of holders 134 may be arranged to be spaced apart from each other in the second direction Y by a predetermined distance. Each of the plurality of holders 134 may include a plurality of holding ribs 134*a* arranged to be spaced apart from each other in the first direction X by a predetermined distance. However, the arranging direction of the plurality of holders 134 and the arranging direction of the plurality of holding ribs 134*a* are not limited to the above example and may be variously changed. The plurality of holding ribs 134*a* may be formed to protrude from the lifting plate 130. As illustrated in FIG. 7, the tableware is fixed to the lifting plate 130 by being sandwiched between the neighboring holding ribs 134*a*.

The frame 110 may further include a wall 115 disposed along a periphery of the loading portion to have a predetermined height in the height direction H of the dishwasher 1. The wall 115 of the frame 110 may include a first wall 115*a* facing the opening portion 12*a* of the tub 12, a second wall 115*b* facing the first wall 115*a*, and a third wall 115*c* and a fourth wall 115*d* connecting the first wall 115*a* and the second wall 115*b*. As an example, the first wall 115*a* of the frame 110 may face the front of the tub 12 and the second wall 115*b* of the frame 110 may face the rear surface of the tub 12. The third wall 115*c* and the fourth wall 115*d* of the frame 110 may face the right and left surfaces of the tub 12, respectively.

As illustrated in FIG. 4, the wall 115 of the frame 110 may be formed in a double wall structure. Specifically, the wall 115 of the frame 110 may include an inner wall 116 disposed to be adjacent to the loading portion and an outer wall 117 disposed outside the inner wall 116. The inner wall 116 and the outer wall 117 may be disposed to be spaced apart from each other. The inner wall 116 of the wall 115 of the frame 110 may define an edge of the loading portion. That is, the inner wall 116 of the wall 115 of the frame 110 may define an edge of the fixing plate 111.

An operating member guide portion for guiding the rotation of the first and second operating members 151 and 152 or limiting a rotation range of the first and second operating members 151 and 152 may be formed on an inner surface of the wall 115 facing the first and second operating members 151 and 152. Specifically, the operating member guide portion may include a guide rib 123 (refer to FIG. 9) for guiding the movement of the first and second operating members 151 and 152, and rotation restricting ribs 121 and 122 (refer to FIG. 9) for restricting the rotation range of the first and second operating members 151 and 152. The guide rib 123 may be formed on an inner surface of the first wall 115*a* facing the first and second operating members 151 and 152. The rotation restricting ribs 121 and 122 may be formed on an inner surface of the first wall 115*a* facing the first and second operating members 151 and 152.

The rotation restricting ribs 121 and 122 may include the first rotation restricting rib 121 positioned outside the lifting plate 130, and the second rotation restricting rib 122 positioned inside the lifting plate 130. The first rotation restricting rib 121 and the second rotation restricting rib 122 may be disposed to be spaced apart from each other. The distance between the first rotation restricting rib 121 and the second rotation restricting rib 122 may be increased toward an upper side in the height direction H of the dishwasher 1. The first rotation restricting rib 121 may be provided to interfere with the first and second operating members 151 and 152 when the lifting plate 130 is raised. The second rotation restricting rib 122 may be provided to interfere with the first and second operating members 151 and 152 when the lifting plate 130 is lowered.

The guide rib 123 may be formed on the inner surface of the first wall 115*a* to be positioned between the first rotation restricting rib 121 and the second rotation restricting rib 122. The guide rib 123 may have a shape corresponding to the rotation route of the first and second operating members 151 and 152. The guide rib 123 may include a curved surface. The guide rib 123 may have an arc shape. The first and second operating members 151 and 152 may include a guide protrusion 124 formed to move along the guide rib 123. The rotation of the first and second operating members 151 and 152 may be guided by the interaction of the guide rib 123 and the guide protrusion 124 (refer to FIG. 5).

The frame 110 may further include at least one lifting induction member holder 125. The at least one lifting induction member holder 125 may be disposed to be spaced apart from each other by a predetermined distance along the axial direction X of the lifting induction member 140. The at least one lifting induction member holder 125 may extend from the fixing plate 111 of the frame 110 toward the lifting plate 130 to be coupled to the lifting induction member 140. The at least one lifting induction member holder 125 may have a hook shape so that the lifting induction member 140 may be fitted. However, the shape of the at least one lifting induction member holder 125 is not limited to the above example and may be variously changed.

As illustrated in FIG. 4, a plurality of reinforcing ribs 127 may be formed on the frame 110 to reinforce the rigidity of the frame 110. The plurality of reinforcing ribs 127 may be formed on the wall 115 of the frame 110. Specifically, the plurality of reinforcing ribs 127 may be formed at the inside of the wall 115. More specifically, the plurality of reinforcing ribs 127 may be formed between the inner wall 116 and the outer wall 117 of the wall 115 of the frame 110 along the periphery of the loading portion. The positions where the plurality of reinforcing ribs 127 are formed are not limited to the above example and may be variously changed. Opposite ends of the lifting induction member 140 may be rotatably coupled to the first wall 115*a* and the second wall 115*b* of the frame 110, respectively. Specifically, the first end of the lifting induction member 140 which faces the opening portion 12*a* of the tub 12 in the axial direction X of the lifting induction member 140 may be rotatably coupled to the first wall 115*a* of the frame 110, and a second end of the lifting induction member 140 positioned at the opposite side of the first end of the lifting induction member 140 in the axial direction X of the lifting induction member 140 may be rotatably coupled to the second wall 115*b* of the frame 110.

The lifting induction member 140 may include a first lifting induction member 141 rotatably coupled to a first end of the lifting plate 130, and a second lifting induction member 142 rotatably coupled to a second end of the lifting plate 130. The first lifting induction member 141 and the second lifting induction member 142 may be parallel to each other. The first lifting induction member 141 may be disposed between the lifting plate 130 and the fixing plate 111 positioned at a right region of the frame 110. The second lifting induction member 142 may be disposed between the lifting plate 130 and the fixing plate 111 positioned at a left region of the frame 110.

The lifting plate 130 may move in conjunction with the lifting induction member 140. Specifically, the first end of the lifting plate 130 may move in conjunction with the first lifting induction member 141, and the second end of the lifting plate 130 may move in conjunction with the second lifting induction member 142.

The first and second operating members 151 and 152 may be provided to adjust the height of at least one of the first end and the second end of the lifting plate 130. Specifically, the first and second operating members 151 and 152 may include the first operating member 151 that is coupled to the first lifting induction member 141 to adjust the height of the first end of the lifting plate 130 by rotating the first lifting induction member 141, and the second operating member 152 that is coupled to the second lifting induction member 142 to adjust the height of the second end of the lifting plate 130 by rotating the second lifting induction member 142 separately from the first lifting induction member 141.

The first and second operating members 151 and 152 may be rotatably coupled to the lifting induction member 140. That is, the first and second operating members 151 and 152 may be coupled to the lifting induction member 140 to be rotatable about the lifting induction member 140. The first and second operating members 151 and 152 may have the shape of a pivotable lever. However, the shape of the first and second operating members 151 and 152 is not limited to the above example and may be variously changed.

A first end of the link member 160 may be coupled to the lifting plate 130 and a second end of the link member 160 may be coupled to the lifting induction member 140. The link member 160 may include an arm 163 formed at the first end of the link member 160 to be movably coupled to a guide slot 170.

The lifting plate 130 may include the guide slot 170 provided to correspond to the link member 160. The arm 163 of the link member 160 may be movably coupled to the guide slot 170 of the lifting plate 130. The guide slot 170 may have a cut shape elongated in the second direction Y.

The guide slot 170 may include a first end 171 (refer to FIG. 9) adjacent to the lifting induction member 140 and a second end 172 (refer to FIG. 9) positioned opposite the first end 171. The second end 172 of the guide slot 170 may be positioned above the first end 171 of the guide slot 170 in the height direction H of the dishwasher 1. The guide slot 170 may further include a connection portion 173 (refer to FIG. 9) connecting the first end 171 and the second end 172 of the guide slot 170 so that the arm 163 of the link member 160 moves together. The connection portion 173 may be flat without bending.

When the arm 163 of the link member 160 is positioned at the first end 171 of the guide slot 170, the lifting plate 130 may be lowered in the height direction H of the dishwasher 1. On the contrary, when the arm 163 of the link member 160 is positioned at the second end 172 of the guide slot 170, the lifting plate 130 may be raised in the height direction H of the dishwasher 1.

The link member 160 may include a first link member 161 connecting the first end of the lifting plate 130 and the first lifting induction member 141, and a second link member 162 connecting the second end of the lifting plate 130 and the second lifting induction member 142. The arm 163 formed at the first end of the first link member 161 may be movably coupled to a first guide slot 175 provided at the first end of the lifting plate 130. The arm 163 formed at the first end of the second link member 162 may be movably coupled to a second guide slot 176 provided at the second end of the lifting plate 130.

The link member 160 may include a first link unit 165 connecting the first end of the lifting induction member 140 and the lifting plate 130, and a second link unit 166 connecting the second end of the lifting induction member 140 and the lifting plate 130. The first link unit 165 and the first and second operating members 151 and 152 may be integrally formed.

A first end of the at least one connection member 300 may be coupled to the lifting plate 130, and a second end of the at least one connection member 300 may be coupled to the lifting induction member 140. The lifting induction member 140 may be rotatably coupled to the second end of the at least one connection member 300. Specifically, the lifting induction member 140 may be rotatably coupled to a through hole (not shown) formed on the second end of the at least one connection member 300.

The at least one connection member 300 may serve to firmly connect the lifting plate 130 and the lifting induction member 140 together with the link member 160. In addition, the at least one connection member 300 may prevent the tableware placed on the loading portion from falling through a gap between the fixing plate 111 and the lifting plate 130.

The rack assembly 100 may further include a roller 180 that is rotatably mounted on the frame 110. The roller 180 may be rotatably mounted on the frame 110 to be movable along the guide rail 290.

The frame 110 forming the outer appearance of the rack assembly 100 may be injection-molded. Specifically, the loading portion and the wall 115 of the frame 110 forming the outer appearance of the rack assembly 100 may be integrally injection-molded. More specifically, the fixing plate 111 and the wall 115 may be integrally injection-molded. The frame 110 may be made of a plastic material.

The lifting induction member 140 rotatably coupled to the frame 110 may be made of a metal material. As an example, the lifting induction member 140 may be made of a steel material. The lifting induction member 140 may not only serve as a rotation shaft of the first and second operating members 151 and 152, but also serve to provide rigidity to the frame 110 to prevent the frame 110 from being deformed. In particular, the lifting induction member 140 may provide rigidity to the center of the frame 110 so that the center of the frame 110 is not bent or twisted.

Compared to a conventional rack assembly comprising a metallic wire frame and an accommodating container coupled to the wire frame, because the rack assembly 100 of the present disclosure uses the frame 110 formed only of plastic instead of using a metallic wire frame, it is possible to realize a rack assembly that is relatively light and low in manufacturing cost. In addition, because the rack assembly 100 of the present disclosure may be integrally manufactured by injection molding the frame 110 forming the outer appearance, the conventional process of joining the accommodating container to the metallic wire frame may be omitted. Accordingly, the manufacturing process of the rack assembly 100 of the present disclosure may be simpler than the manufacturing process of the conventional rack assembly.

Figure 8:
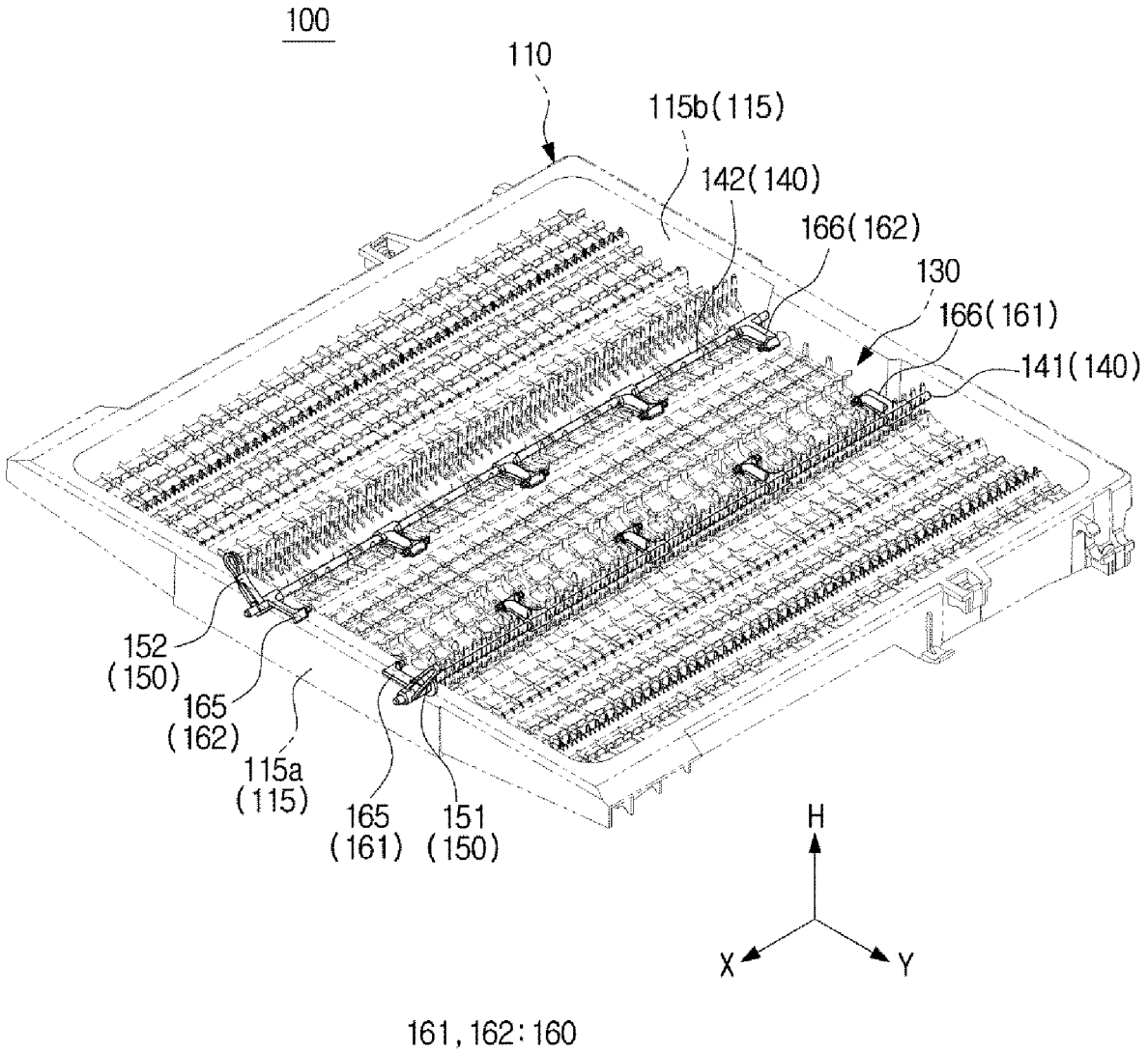
FIG. 8 is a perspective view illustrating a state in which a lifting plate of a rack assembly in a dishwasher according to an embodiment of the present disclosure is in a first state.
Figure 9:
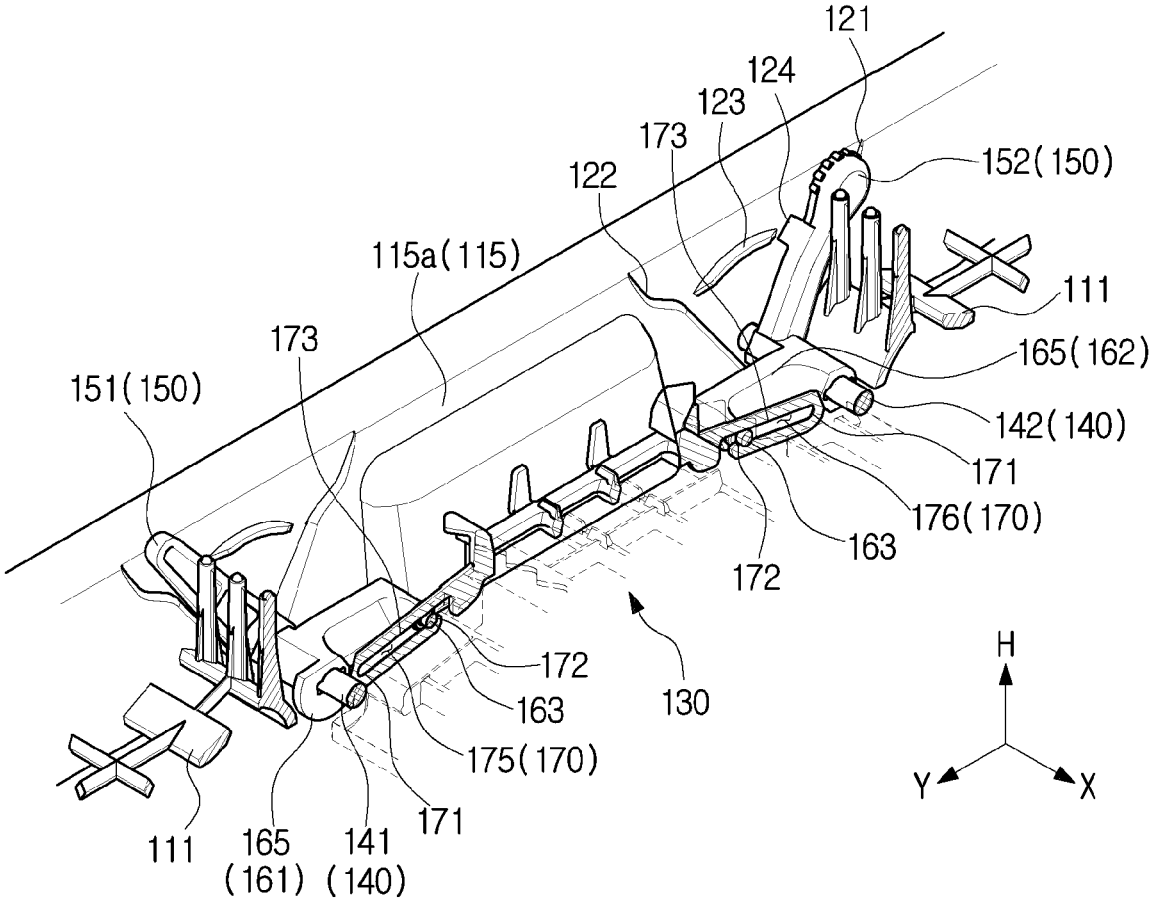
FIG. 9 is a view illustrating a relationship of an operating member, a lifting plate and a link member when the lifting plate of a rack assembly in a dishwasher according to an embodiment of the present disclosure is in the first state.

FIG. 8 is a perspective view illustrating a state in which a lifting plate of a rack assembly in a dishwasher according to an embodiment of the present disclosure is in a first state, and FIG. 9 is a view illustrating a relationship of an operating member, a lifting plate, and a link member when the lifting plate of a rack assembly in a dishwasher according to an embodiment of the present disclosure is in the first state.

As illustrated in FIGS. 8 and 9, the lifting plate 130 of the rack assembly 100 may be raised in the height direction H of the dishwasher 1. The lifting plate 130 may be raised up to a position substantially at the same position as the fixing plate 111 of the frame 110 in the height direction H of the dishwasher 1. That is, the opposite ends of the lifting plate 130 may be raised to the same degree in the height direction H of the dishwasher 1. As such, the state in which the opposite ends of the lifting plate 130 are raised up to a position substantially at the same position as the fixing plate 111 of the frame 110 in the height direction H of the dishwasher 1 is defined as a "first state."

When the user rotates the first operating member 151 in a direction away from the lifting plate 130, the first lifting induction member 141 rotates integrally with the first operating member 151. At this time, the arm 163 of the first link member 161 moves to the second end 172 of the first guide slot 175 in a state of being coupled to the first guide slot 175 of the lifting plate 130. The rotation of the first operating member 151 may be guided by the guide rib 123 and may be restricted by the first rotation restricting rib 121. That is, the first operating member 151 may be rotated in the direction away from the lifting plate 130 until the first operating member 151 is interfered by the first rotation restricting rib 121. When the arm 163 of the first link member 161 is positioned at the second end 172 of the first guide slot 175, the first end of the lifting plate 130 may be positioned at substantially the same position as the fixing plate 111 of the frame 110 in the height direction H of the dishwasher 1.

When the user rotates the second operating member 152 in the direction away from the lifting plate 130 to the same degree as the rotation of the first operating member 151, the second lifting induction member 142 rotates integrally with the second operating member 152. At this time, the arm 163 of the second link member 162 moves to the second end 172 of the second guide slot 176 in a state of being coupled to the second guide slot 176 of the lifting plate 130. The rotation of the second operating member 152 may be guided by the guide rib 123 and may be restricted by the first rotation restricting rib 121. That is, the second operating member 152 may be rotated in the direction away from the lifting plate 130 until the second operating member 152 is interfered by the first rotation restricting rib 121. When the arm 163 of the second link member 162 is positioned at the second end 172 of the second guide slot 176, the second end of the lifting plate 130 may be positioned at substantially the same position as the fixing plate 111 of the frame 110 in the height direction H of the dishwasher 1.

The user may rotate the first operating member 151 and the second operating member 152 simultaneously or sequentially.

The degree of rotation of the first operating member 151 and the degree of rotation of the second operating member 152 may be the same.

In this case, because a space between the rack assembly 100 and the upper basket 51 is extended, the user may use the upper basket 51 more easily. That is, the user may accommodate tableware having a larger volume in the upper basket 51.

Figure 10:
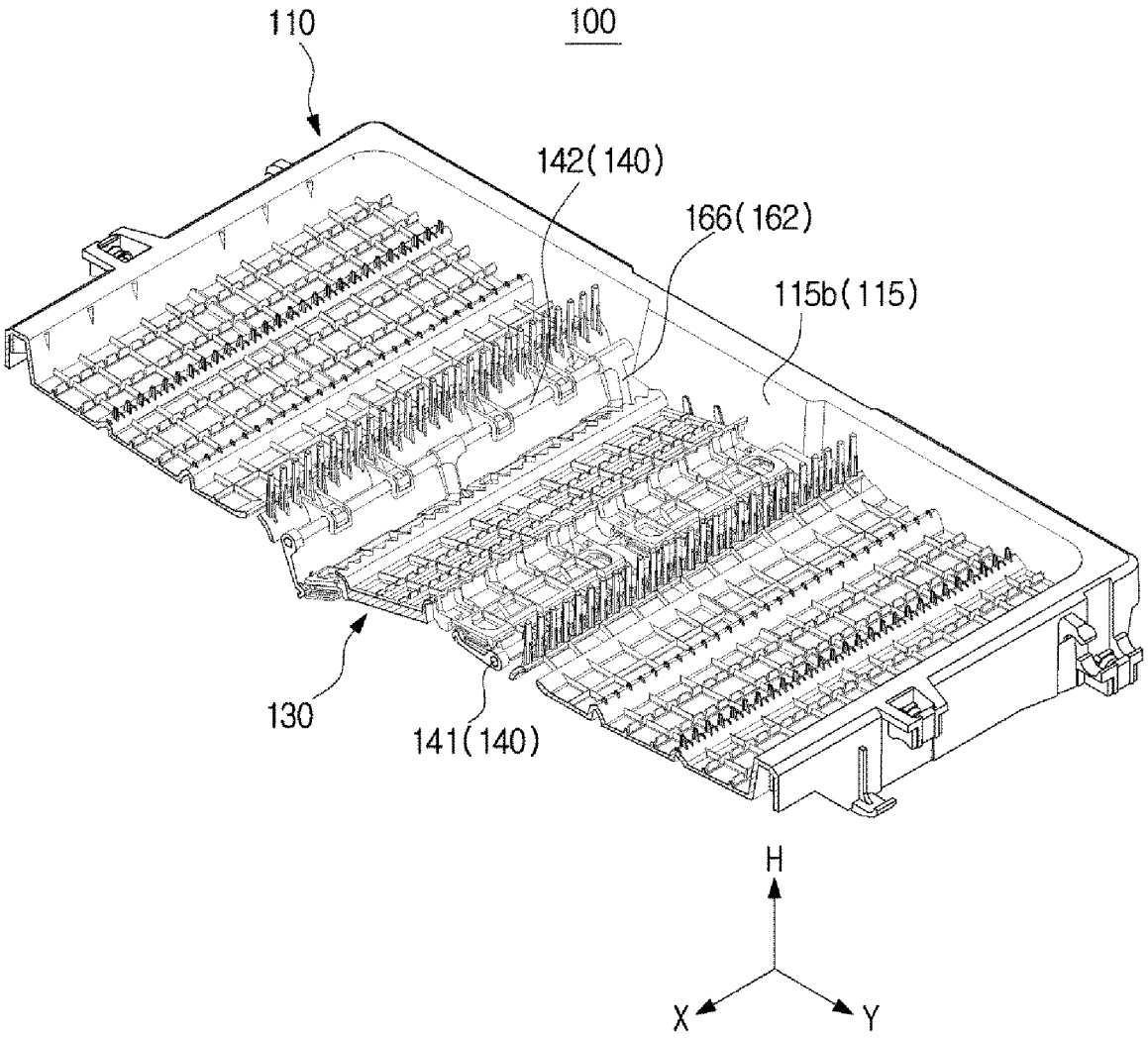
FIG. 10 is a perspective view illustrating a state in which a lifting plate of a rack assembly in a dishwasher according to an embodiment of the present disclosure is in a second state.
Figure 11:
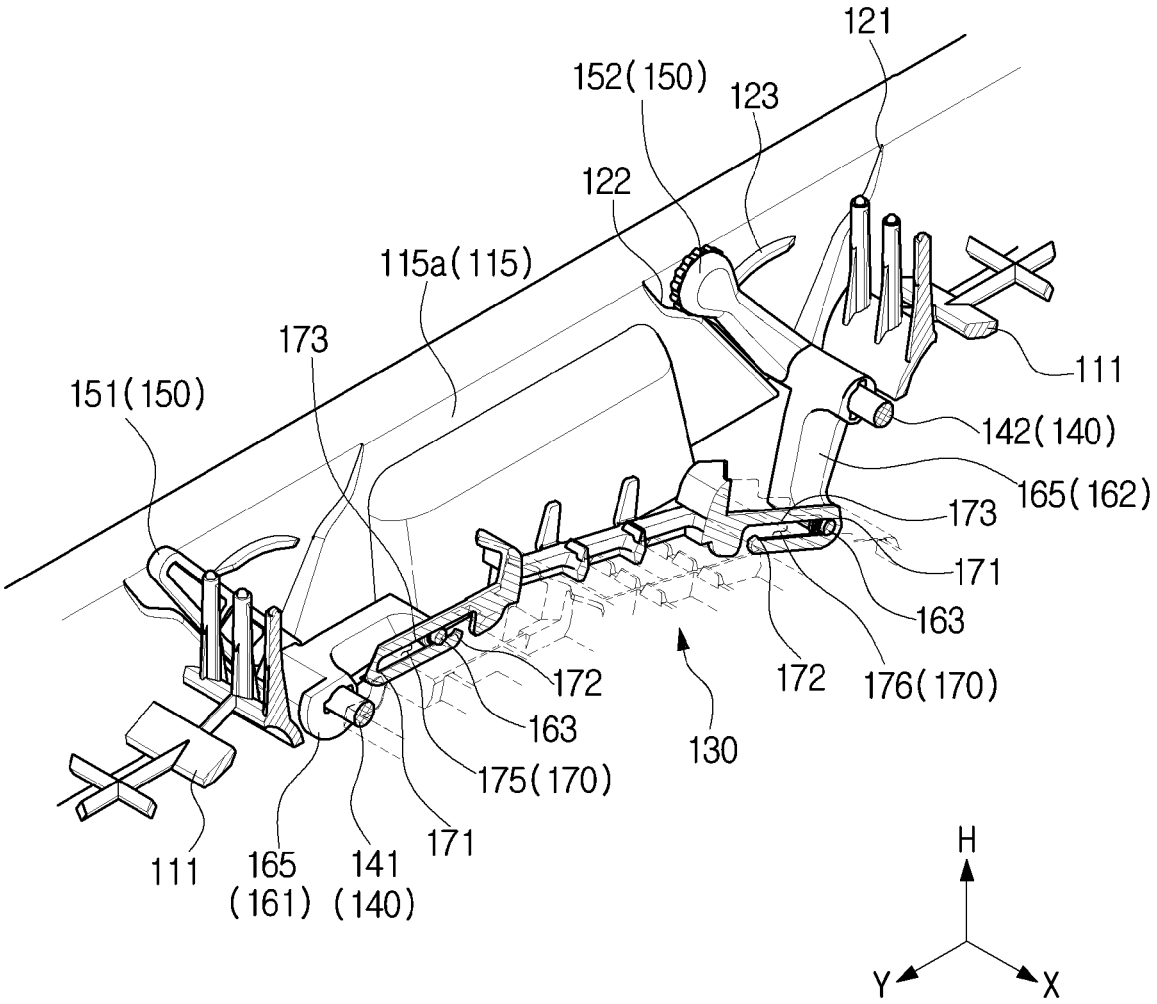
FIG. 11 is a view illustrating a relationship of an operating member, a lifting plate and a link member when the lifting plate of a rack assembly in a dishwasher according to an embodiment of the present disclosure is in the second state.

FIG. 10 is a perspective view illustrating a state in which a lifting plate of a rack assembly in a dishwasher according to an embodiment of the present disclosure is in a second state, and FIG. 11 is a view illustrating a relationship of an operating member, a lifting plate, and a link member when the lifting plate of a rack assembly in a dishwasher according to an embodiment of the present disclosure is in the second state.

As illustrated in FIGS. 10 and 11, the lifting plate 130 of the rack assembly 100 may be provided to be inclined. Specifically, the lifting plate 130 of the rack assembly 100 may be provided such that the positions of the first end and the second end of the lifting plate 130 are different in the height direction H of the dishwasher 1. As such, the state in which the first end and the second end of the lifting plate 130 are positioned at different positions in the height direction H of the dishwasher 1 is defined as a "second state." Hereinafter, the case where the first end of the lifting plate 130 is raised and the second end of the lifting plate 130 is lowered will be mainly described.

When the user rotates the first operating member 151 in the direction away from the lifting plate 130, the first lifting induction member 141 rotates integrally with the first operating member 151. At this time, the arm 163 of the first link member 161 moves to the second end 172 of the first guide slot 175 in a state of being coupled to the first guide slot 175 of the lifting plate 130. The rotation of the first operating member 151 may be guided by the guide rib 123 and may be restricted by the first rotation restricting rib 121. That is, the first operating member 151 may be rotated in the direction away from the lifting plate 130 until the first operating member 151 is interfered by the first rotation restricting rib 121. When the arm 163 of the first link member 161 is positioned at the second end 172 of the first guide slot 175, the first end of the lifting plate 130 may be positioned at substantially the same position as the fixing plate 111 of the frame 110 in the height direction H of the dishwasher 1.

When the user rotates the second operating member 152 in a direction of approaching the lifting plate 130, the second lifting induction member 142 rotates integrally with the second operating member 152. At this time, the arm 163 of the second link member 162 moves to the first end 171 of the second guide slot 176 in a state of being coupled to the second guide slot 176 of the lifting plate 130. The rotation of the second operating member 152 may be guided by the guide rib 123 and may be restricted by the second rotation restricting rib 122. That is, the second operating member 152 may be rotated in the direction of approaching the lifting plate 130 until the second operating member 152 is interfered by the second rotation restricting rib 122. When the arm 163 of the second link member 162 is positioned at the first end 171 of the second guide slot 176, the second end of the lifting plate 130 may be positioned below the fixing plate 111 of the frame 110 in the height direction H of the dishwasher 1 to form a step with the fixing plate 111 of the frame 110.

The user may rotate the first operating member 151 and the second operating member 152 simultaneously or sequentially.

The rotation direction of the first operating member 151 and the rotation direction of the second operating member 152 may be different from each other.

In this case, because a space between the second end of the lifting plate 130 and the upper surface of the tub 12 is extended, the user may use the second end of the lifting plate 130 more easily. That is, the user may accommodate tableware having a larger volume in the second end of the lifting plate 130.

Figure 12:
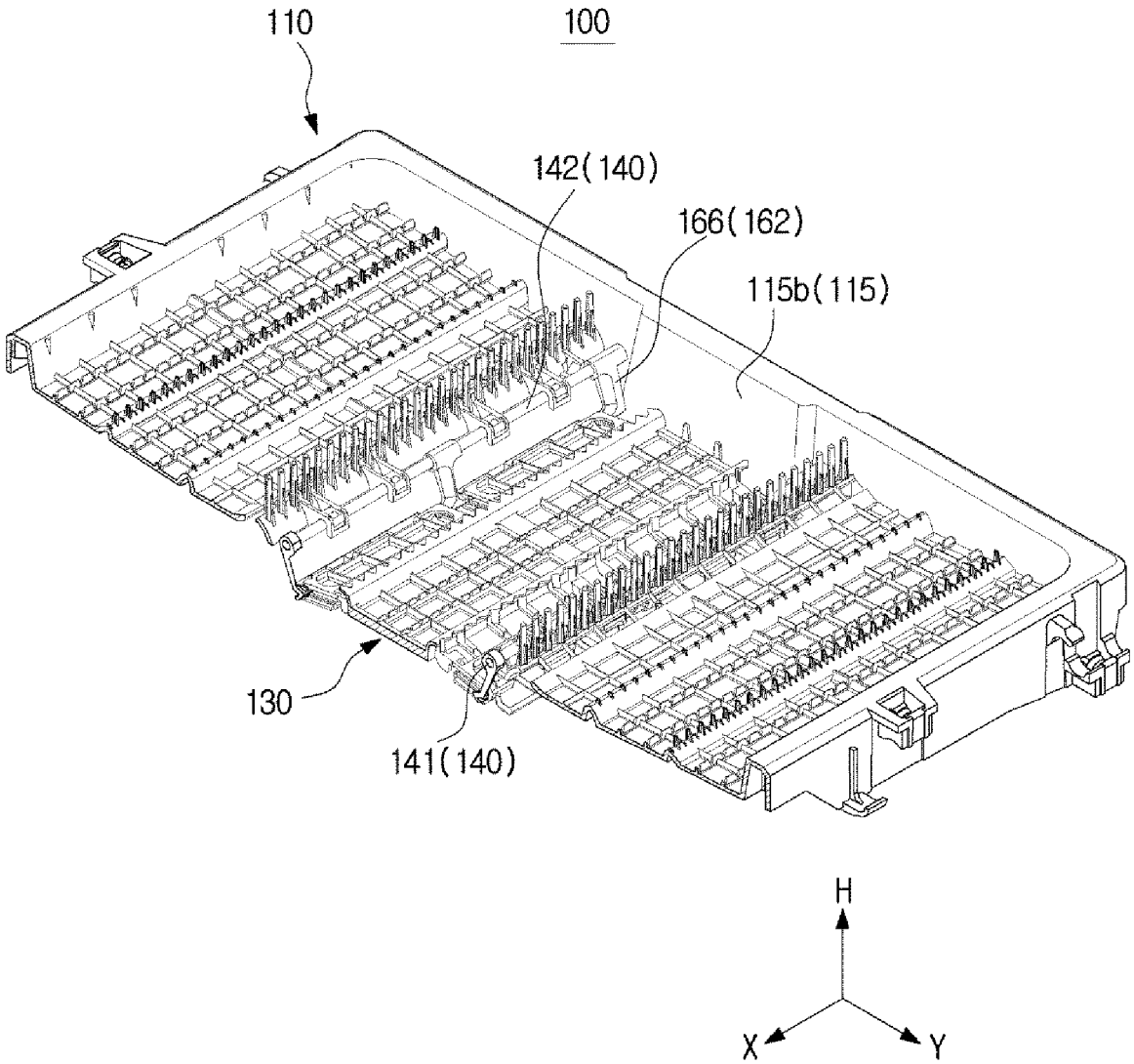
FIG. 12 is a perspective view illustrating a state in which a lifting plate of a rack assembly in a dishwasher according to an embodiment of the present disclosure is in a third state.
Figure 13:
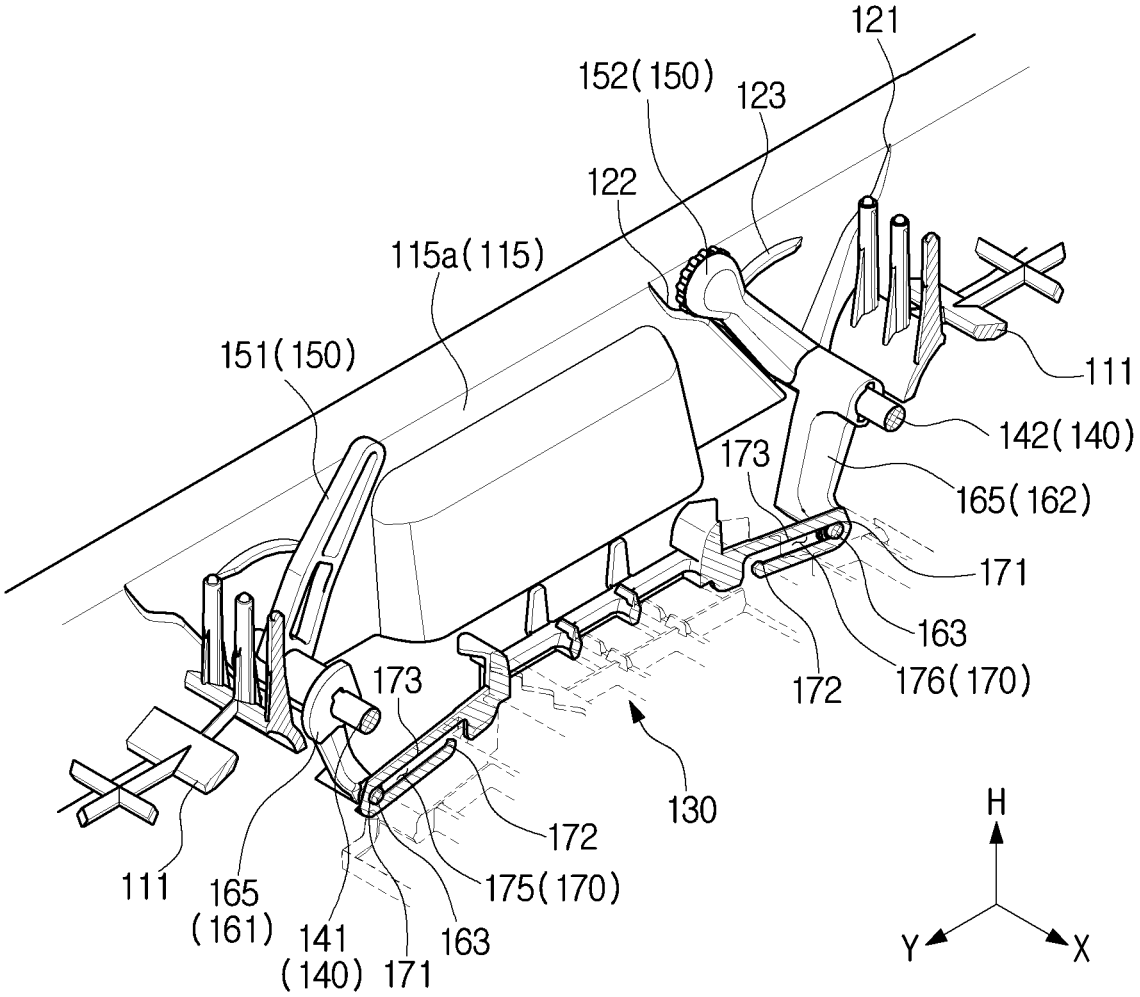
FIG. 13 is a view illustrating a relationship of an operating member, a lifting plate and a link member when the lifting plate of a rack assembly in a dishwasher according to an embodiment of the present disclosure is in the third state.

FIG. 12 is a perspective view illustrating a state in which a lifting plate of a rack assembly in a dishwasher according to an embodiment of the present disclosure is in a third state, and FIG. 13 is a view illustrating a relationship of an operating member, a lifting plate, and a link member when the lifting plate of a rack assembly in a dishwasher according to an embodiment of the present disclosure is in the third state.

As illustrated in FIGS. 12 and 13, the lifting plate 130 of the rack assembly 100 may be lowered in the height direction H of the dishwasher 1. The lifting plate 130 may be lowered until the lifting plate 130 is positioned below the fixing plate 111 of the frame 110 in the height direction H of the dishwasher 1. That is, the opposite ends of the lifting plate 130 may be lowered to the same degree in the height direction H of the dishwasher 1. At this time, a step may be formed between the lifting plate 130 and the fixing plate 111. As such, the state where the opposite ends of the lifting plate 130 are lowered until the opposite ends of the lifting plate 130 are positioned below the fixing plate 111 of the frame 110 in the height direction H of the dishwasher 1 is defined as a "third state."

When the user rotates the first operating member 151 in the direction of approaching the lifting plate 130, the first lifting induction member 141 rotates integrally with the first operating member 151. At this time, the arm 163 of the first link member 161 moves to the first end 171 of the first guide slot 175 in a state of being coupled to the first guide slot 175 of the lifting plate 130. The rotation of the first operating member 151 may be guided by the guide rib 123 and may be restricted by the second rotation restricting rib 122. That is, the first operating member 151 may be rotated in the direction of approaching the lifting plate 130 until the first operating member 151 is interfered by the second rotation restricting rib 122. When the arm 163 of the first link member 161 is positioned at the first end 171 of the first guide slot 175, the first end of the lifting plate 130 may be positioned below the fixing plate 111 of the frame 110 in the height direction H of the dishwasher 1.

When the user rotates the second operating member 152 in the direction of approaching the lifting plate 130, the second lifting induction member 142 rotates integrally with the second operating member 152. At this time, the arm 163 of the second link member 162 moves to the first end 171 of the second guide slot 176 in a state of being coupled to the second guide slot 176 of the lifting plate 130. The rotation of the second operating member 152 may be guided by the guide rib 123 and may be restricted by the second rotation restricting rib 122. That is, the second operating member 152 may be rotated in the direction of approaching the lifting plate 130 until the second operating member 152 is interfered by the second rotation restricting rib 122. When the arm 163 of the second link member 162 is positioned at the first end 171 of the second guide slot 176, the second end of the lifting plate 130 may be positioned below the fixing plate 111 of the frame 110 in the height direction H of the dishwasher 1.

The user may rotate the first operating member 151 and the second operating member 152 simultaneously or sequentially.

The degree of rotation of the first operating member 151 and the degree of rotation of the second operating member 152 may be the same.

In this case, because a space between the rack assembly 100 and the upper surface of the tub 12 is extended, the user may use the rack assembly 100 more easily. That is, the user may accommodate tableware having a larger volume in the rack assembly 100.

Figure 14:
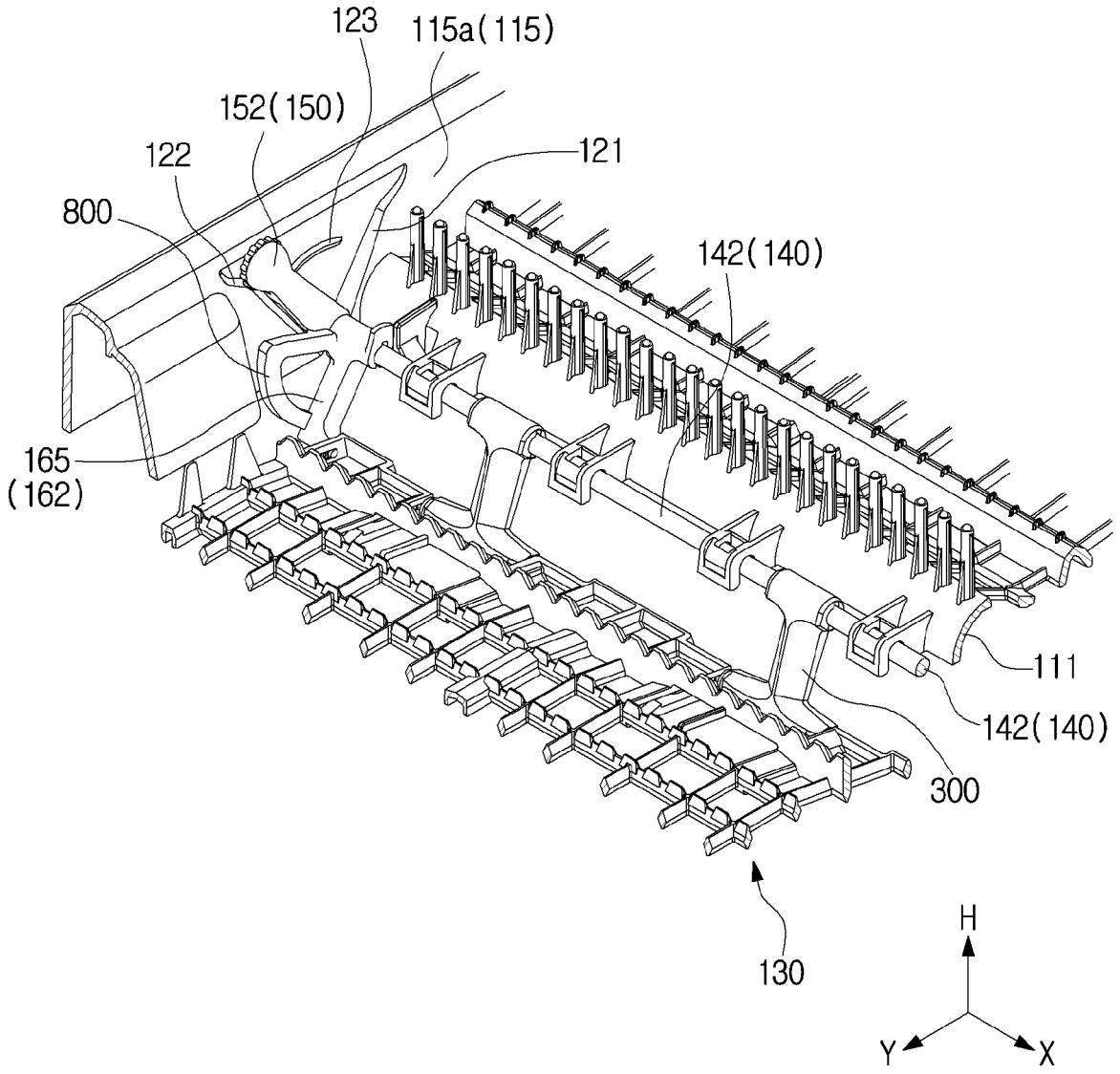
FIG. 14 is a view illustrating a rack assembly according to a first additional embodiment in a dishwasher according to an embodiment of the present disclosure.

FIG. 14 is a view illustrating a rack assembly according to a first additional embodiment in a dishwasher according to an embodiment of the present disclosure. Hereinafter, a description overlapping with those described through FIGS. 1 to 13 will be omitted. Hereinafter, the same reference numerals are assigned to the same components as those described with reference to FIGS. 1 to 13.

As illustrated in FIG. 14, a coupling rib 800 may be disposed at the rear of the first and second operating members 151 and 152. The coupling rib 800 may be coupled to at least one of the first and second operating members 151 and 152 and the link member 160. The coupling rib 800 may be integrally formed with at least one of the first and second operating members 151 and 152 and the link member 160. The coupling rib 800 may be provided to move integrally with the first and second operating members 151 and 152. The coupling rib 800 may have an arc shape. As an example, the coupling rib 800 may have a fan shape. However, the shape of the coupling rib 800 is not limited to the above example and may be variously changed.

The coupling rib 800 may be spaced apart from the first wall 115*a* of the frame 110 not to interfere with the movement of the first and second operating members 151 and 152. That is, the coupling rib 800 may be disposed at the rear of the first and second operating members 151 and 152 to be spaced apart from the first wall 115*a* of the frame 110.

The coupling rib 800 may perform a similar role to the at least one connecting member 300. Specifically, the coupling rib 800 may prevent the tableware placed on the loading portion from falling through the gap between the fixing plate 111 and the lifting plate 130. More specifically, the coupling rib 800 may prevent the tableware placed on the loading portion from falling through the gap between the fixing plate 111, the lifting plate 130, and the first wall 115*a* of the frame 110.

Figure 15:
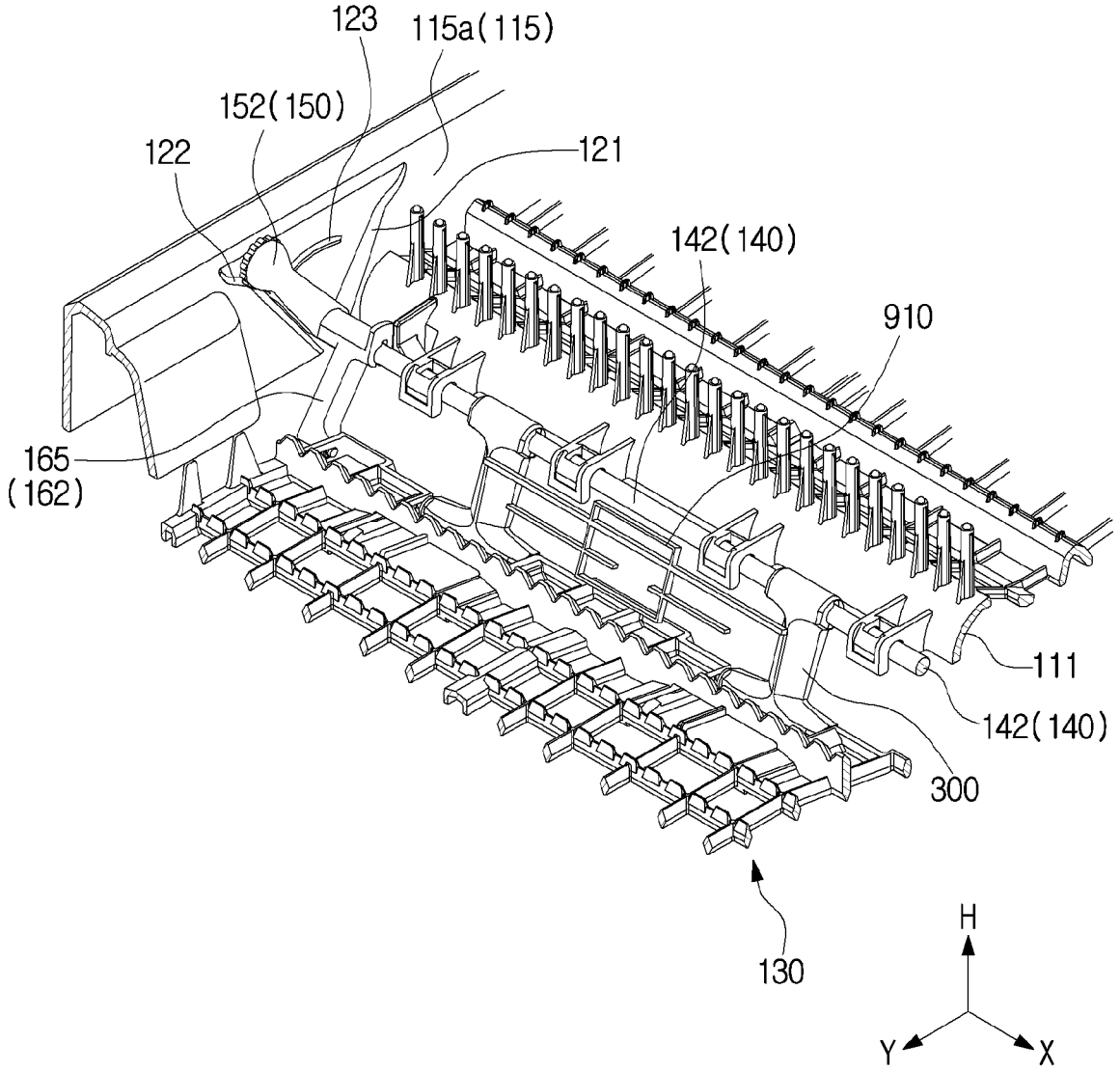
FIG. 15 is a view illustrating a rack assembly according to a second additional embodiment in a dishwasher according to an embodiment of the present disclosure.

FIG. 15 is a view illustrating a rack assembly according to a second additional embodiment in a dishwasher according to an embodiment of the present disclosure. Hereinafter, a description overlapping with those described through FIGS. 1 to 13 will be omitted. Hereinafter, the same reference numerals are assigned to the same components as those described with reference to FIGS. 1 to 13.

As illustrated in FIG. 15, the rack assembly 100 may include a plurality of the connecting members 300. A connecting rib 910 may be disposed between a plurality of the neighboring connecting members 300. That is, the plurality of neighboring connecting members 300 may be connected to each other by the connecting rib 910. The connecting rib 910 may be disposed between the link member 160 and the plurality of connecting members 300 adjacent to the link member 160. That is, the connecting rib 910 may also connect the link member 160 and the plurality of connecting members 300 adjacent to the link member 160.

The connecting rib 910 may complement the role of the plurality of connecting members 300. Specifically, the connecting rib 910 may prevent the tableware placed on the loading portion from falling through the gap between the fixing plate 111 and the lifting plate 130 with the plurality of connecting members 300.

Figure 16:
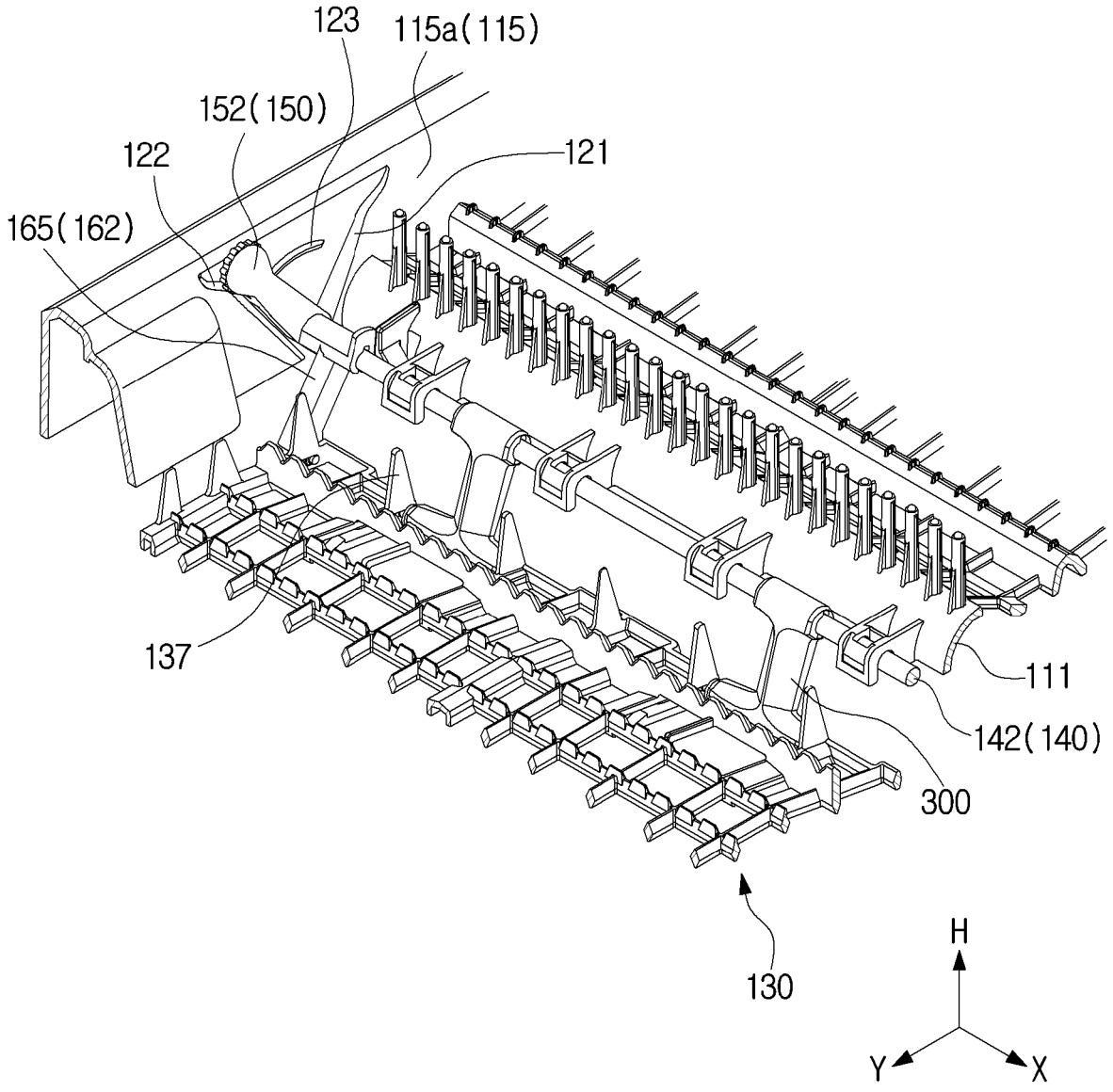
FIG. 16 is a view illustrating a rack assembly according to a third additional embodiment in a dishwasher according to an embodiment of the present disclosure.

FIG. 16 is a view illustrating a rack assembly according to a third additional embodiment in a dishwasher according to an embodiment of the present disclosure. Hereinafter, a description overlapping with those described through FIGS. 1 to 13 will be omitted. Hereinafter, the same reference numerals are assigned to the same components as those described with reference to FIGS. 1 to 13.

As illustrated in FIG. 16, at least one protruding rib 137 may be formed on the lifting plate 130. The at least one protruding rib 137 may be formed at an edge of the lifting plate 130 adjacent to the lifting induction member 140. The at least one protruding rib 137 may protrude from the lifting plate 130. The at least one protruding rib 137 may be integrally formed with the lifting plate 130. Specifically, the at least one protruding rib 137 may be injection-molded integrally with the lifting plate 130.

The at least one protruding rib 137 may prevent the tableware placed on the loading portion from falling through the gap between the fixing plate 111 and the lifting plate 130 with the at least one connecting member 300.

Although FIG. 16 illustrates the case where both the at least one protruding rib 137 and the at least one connecting member 300 are provided, when the at least one protruding rib 137 is provided, the at least one connecting member 300 may be omitted.

Figure 17:
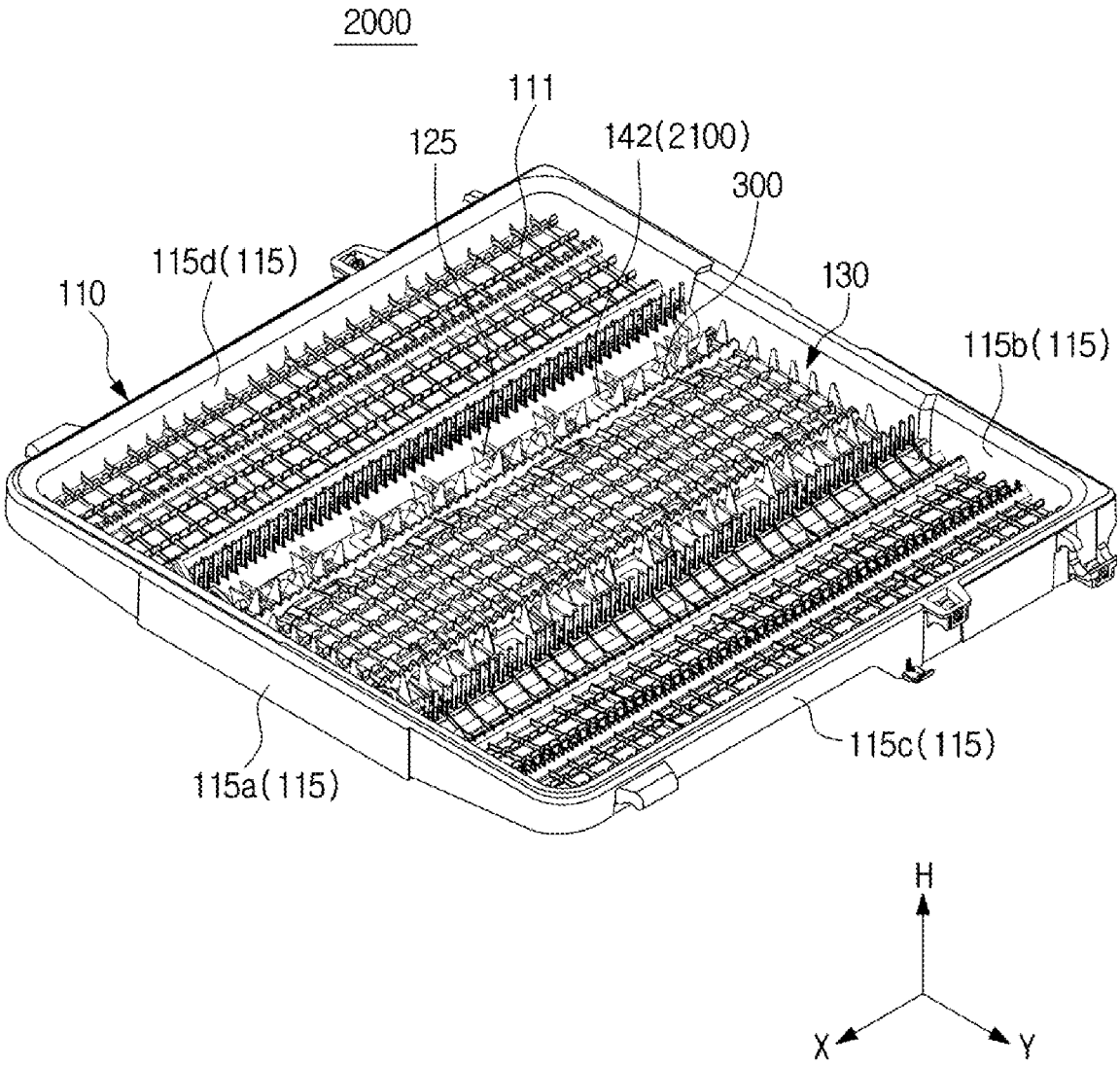
FIG. 17 is a perspective view of a rack assembly in a dishwasher according to an embodiment of the present disclosure.
Figure 18:
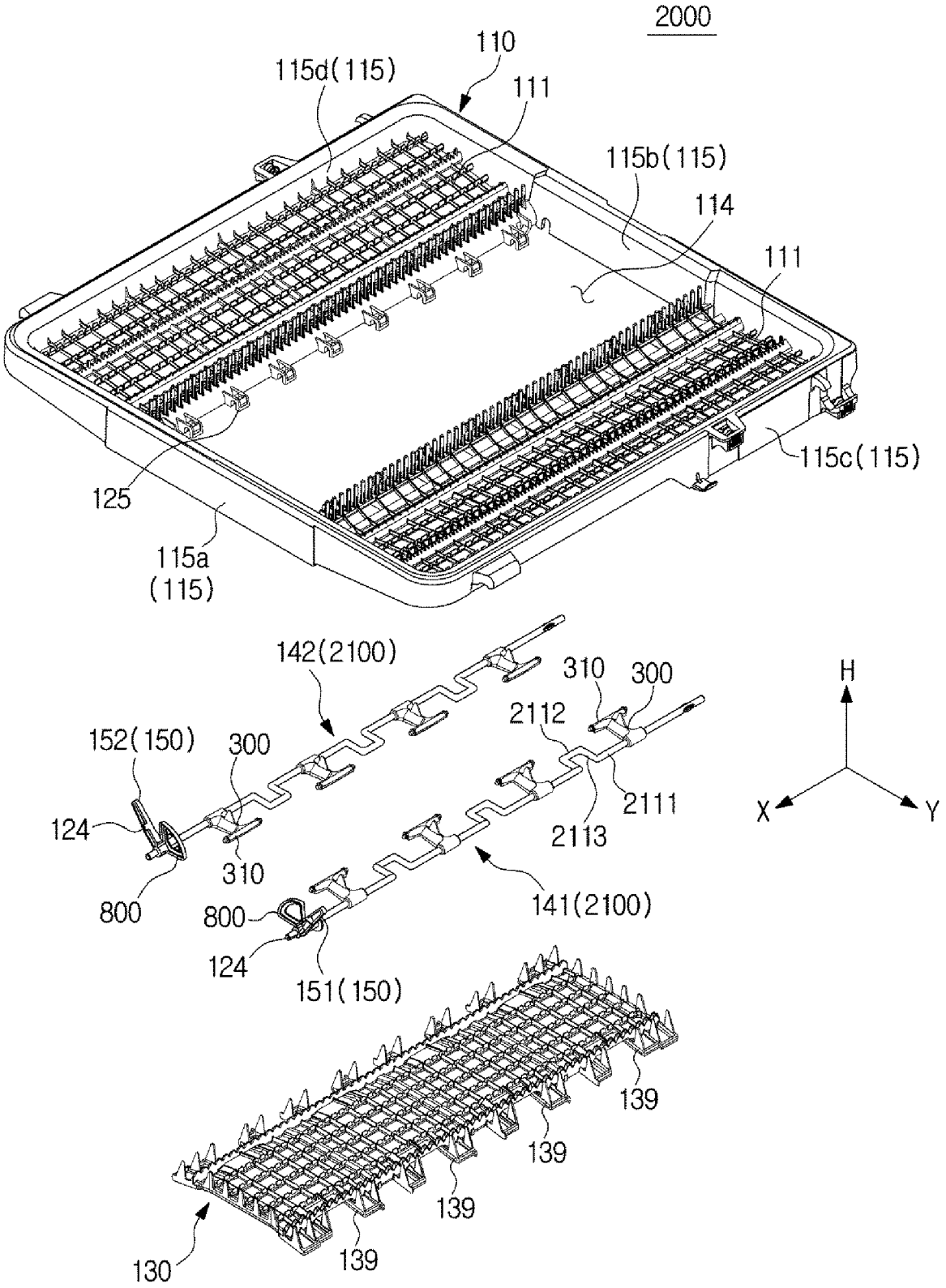
FIG. 18 is an exploded perspective view of a rack assembly in a dishwasher according to an embodiment of the present disclosure.

FIG. 17 is a perspective view of a rack assembly in a dishwasher according to an embodiment of the present disclosure, and FIG. 18 is an exploded perspective view of a rack assembly in a dishwasher according to an embodiment of the present disclosure. Hereinafter, a description overlapping with those described through FIGS. 1 to 14 will be omitted. Hereinafter, the same reference numerals are assigned to the same components as those described with reference to FIGS. 1 to 14.

As illustrated in FIGS. 17 and 18, a rack assembly 2000 may include a lifting induction member 2100 provided to connect the first and second operating members 151 and 152 and the lifting plate 130. The lifting induction member 2100 may be provided to be rotatable. That is, the lifting induction member 2100 may be rotatably coupled to the frame 110 to be positioned between the fixing plate 111 and the lifting plate 130. The lifting plate 130 may move in conjunction with the lifting induction member 2100. The lifting induction member 2100 may extend toward the opening portion 12*a* of the tub 12. Specifically, the lifting induction member 2100 may extend along the first direction X.

The lifting induction member 2100 may include concave-convex portions. Specifically, the lifting induction member 2100 may include a first portion 2111 that is adjacent to the fixing plate 111 and extends along the first direction X. The lifting induction member 2100 may include a second portion 2112 that is adjacent to the lifting plate 130 and extends along the first direction X. The first portion 2111 and the second portion 2112 may be parallel to each other. The lifting induction member 2100 may further include a third portion 2113 that connects the first portion 2111 and the second portion 2112. The third portion 2113 may be orthogonal to the first portion 2111 and the second portion 2112, respectively. However, it suffices that the third portion 2113 may connect the first portion 2111 and the second portion 2112, and the third portion 2113 does not necessarily have to be orthogonal to the first portion 2111 and the second portion 2112.

The first portion 2111 and the second portion 2112 of the lifting induction member 2100 may be alternately arranged along the first direction X.

The lifting induction member 2100 may be coupled to the at least one lifting induction member holder 125. Specifically, the first portion 2111 of the lifting induction member 2100 may be coupled to the at least one lifting induction member holder 125. As an example, the first portion 2111 of the lifting induction member 2100 may be hooked to the at least one lifting induction member holder 125.

The rack assembly 2000 may further include the first and second operating members 151 and 152 provided to be capable of adjusting the height of the lifting plate 130. The lifting plate 130 may move in conjunction with the lifting induction member 2100 by the operation of the first and second operating members 151 and 152. The first and second operating members 151 and 152 may be provided to be adjacent to the opening portion 12*a* of the tub 12 to facilitate access by the user. Therefore, the user may easily adjust the height of the lifting plate 130 without needing to withdraw the rack assembly 2000 from the tub 12.

The coupling rib 800 may be coupled to the first and second operating members 151 and 152. The coupling rib 800 may be integrally formed with the first and second operating members 151 and 152. The coupling rib 800 may have an arc shape. As an example, the coupling rib 800 may have a fan shape. However, the shape of the coupling rib 800 is not limited to the above example and may be variously changed.

The coupling rib 800 may prevent the tableware placed on the loading portion from falling through the gap between the fixing plate 111 and the lifting plate 130. More specifically, the coupling rib 800 may prevent the tableware placed on the loading portion from falling through the gap between the fixing plate 111, the lifting plate 130 and the first wall 115*a* of the frame 110.

The rack assembly 2000 may further include the plurality of connecting members 300 connecting the lifting plate 130 and the lifting induction member 2100.

The first end of the plurality of connecting members 300 may be coupled to the lifting plate 130, and the second end of the plurality of connecting members 300 may be coupled to the lifting induction member 2100. Specifically, the second end of the plurality of connecting members 300 may be coupled to the first portion 2111 of the lifting induction member 2100. More specifically, the second end of the plurality of connecting members 300 may be coupled to the first portion 2111 of the lifting induction member 2100 to be positioned between adjacent ones of the at least one lifting induction member holder 125.

The plurality of connecting members 300 may include an arm 310 formed at the first end of the plurality of connecting members 300 to be movably coupled to a guide slot 139.

The lifting plate 130 may include the guide slot 139 provided to correspond to the plurality of connecting members 300. The arm 310 of the plurality of connecting members 300 may be movably coupled to the guide slot 139 of the lifting plate 130. The guide slot 139 may have a cut shape elongated in the second direction Y.

The guide slot 139 may include a first end adjacent to the lifting induction member 2100 and a second end positioned opposite the first end. The second end of the guide slot 139 may be positioned above the first end of the guide slot 139 in the height direction H of the dishwasher 1. The guide slot 139 may further include a connection portion connecting the first end and the second end of the guide slot 139 so that the arm 310 of the plurality of connecting members 300 moves together. The connection portion may be flat without bending.

When the arm 310 of the plurality of connecting members 300 is positioned at the first end of the guide slot 139, the lifting plate 130 may be lowered in the height direction H of the dishwasher 1. On the contrary, when the arm 310 of the plurality of connecting members 300 is positioned at the second end of the guide slot 139, the lifting plate 130 may be raised in the height direction H of the dishwasher 1.

Figure 19A:
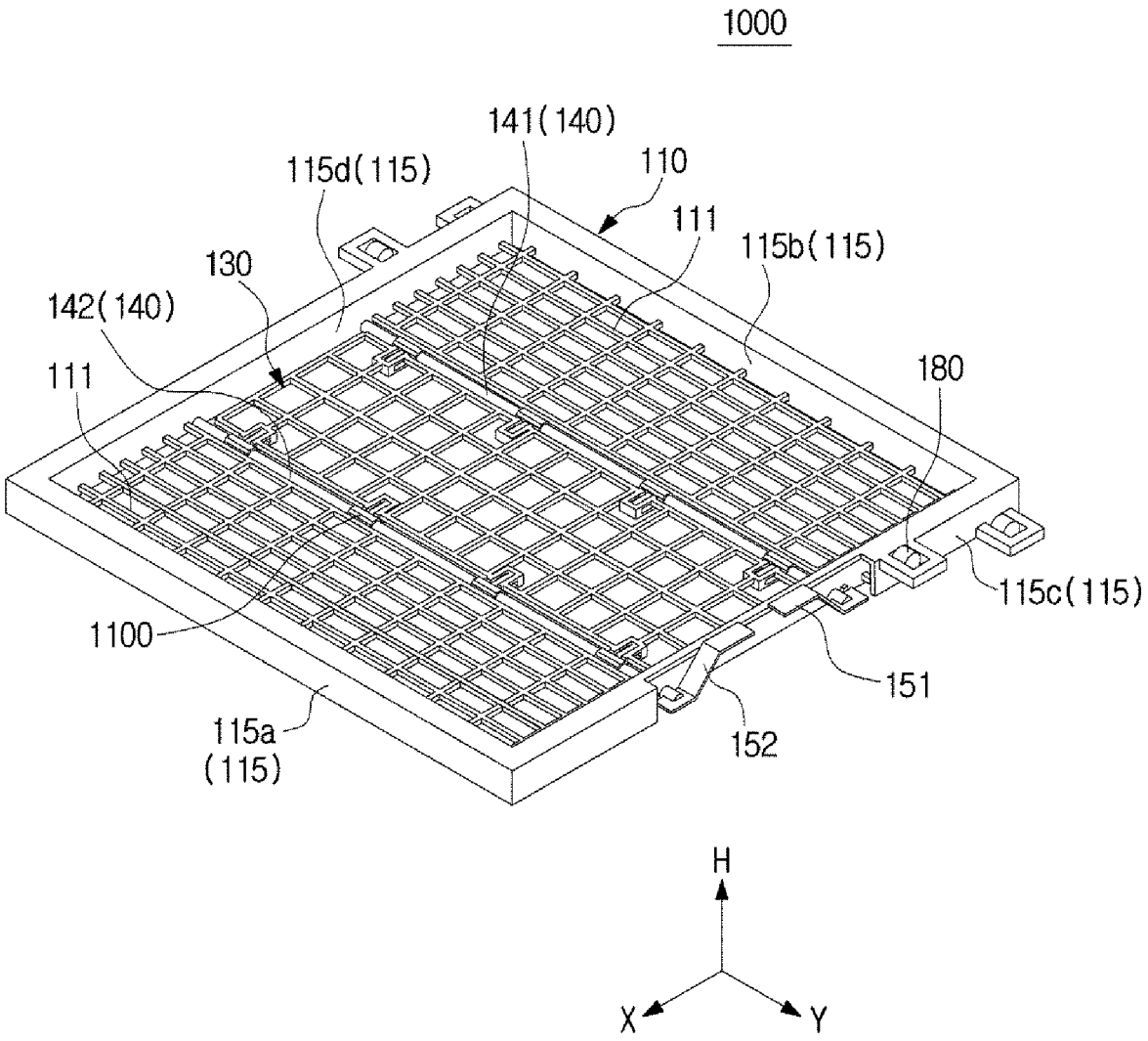
FIGS. 19A and 19B are views illustrating a process of raising and lowering a rack assembly in a dishwasher according to an embodiment of the present disclosure.
Figure 19B:
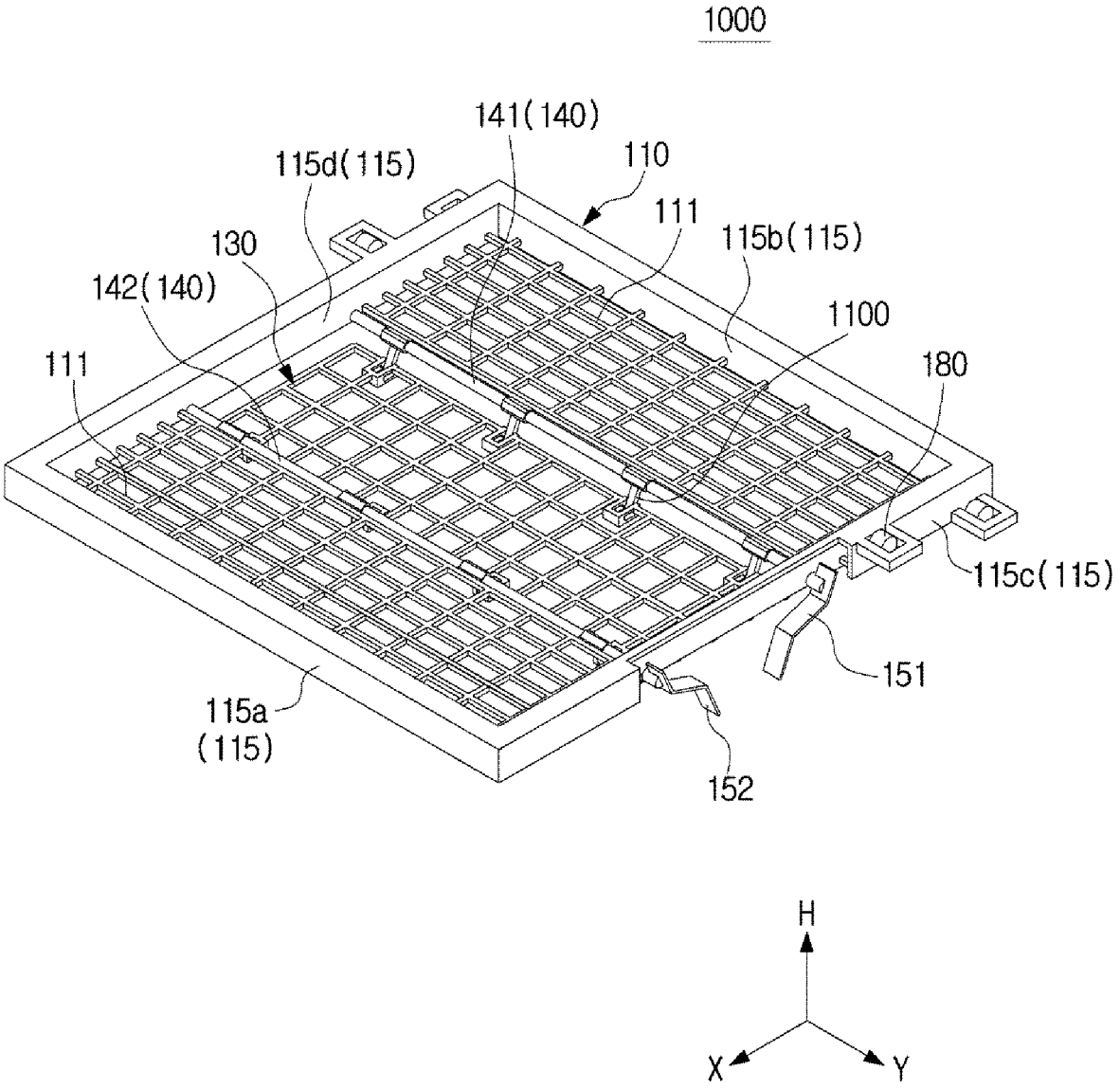

FIGS. 19A and 19B are views illustrating a process of raising and lowering a rack assembly in a dishwasher according to an embodiment of the present disclosure. Hereinafter, a description overlapping with those described through FIGS. 1 to 13 will be omitted. Hereinafter, the same reference numerals are assigned to the same components as those described with reference to FIGS. 1 to 13.

As illustrated in FIGS. 19*a* and 19*b*, the user may adjust the height of the lifting plate 130 on a side of a rack assembly 1000. Specifically, the user may raise or lower the lifting plate 130 by operating the first and second operating members 151 and 152 positioned at the left or right side of the rack assembly 1000.

The lifting plate 130 may move in conjunction with the lifting induction member 140 by the operation of the first and second operating members 151 and 152.

The rack assembly 1000 may include the frame 110 forming an outer appearance of the rack assembly 1000. The frame 110 may include the loading portion on which the tableware is placed. The loading portion may include the fixing plate 111, and the lifting plate 130 that may be raised and lowered.

The rack assembly 1000 may further include the lifting induction member 140 provided to be rotatable. The lifting induction member 140 may extend along the second direction Y of the dishwasher 1. That is, the lifting induction member 140 may extend along the left-right direction of the dishwasher 1. In another respect, the lifting induction member 140 may extend such that opposite ends of the lifting induction member 140 are directed toward the third wall 115*c* and the fourth wall 115*d* of the frame 110, respectively. The opposite ends of the lifting induction member 140 may be rotatably coupled to the third wall 115*c* and the fourth wall 115*d* of the frame 110, respectively.

The rack assembly 1000 may further include the first and second operating members 151 and 152 provided to be capable of adjusting the height of the lifting plate 130. The lifting plate 130 may move in conjunction with the shaft by the operation of the first and second operating members 151 and 152.

The rack assembly 1000 may further include a plurality of connecting members 1100 connecting the lifting plate 130 and the lifting induction member 140. The plurality of connecting members 1100 may be arranged to be spaced apart from a predetermined distance along the axial direction X of the lifting induction member 140.

The lifting induction member 140 may include the first lifting guide member 141 coupled to the first end of the lifting plate 130 to be rotatable, and the second lifting guide member 142 coupled to the second end of the lifting plate 130 to be rotatable. The first lifting induction member 141 and the second lifting induction member 142 may be parallel to each other. The first lifting induction member 141 may be disposed between the lifting plate 130 and the fixing plate 111 located at a rear region of the frame 110. The second lifting induction member 142 may be disposed between the lifting plate 130 and the fixing plate 111 located at a front region of the frame 110.

The lifting plate 130 may move in conjunction with the lifting induction member 140. Specifically, the first end of the lifting plate 130 may move in conjunction with the first lifting induction member 141, and the second end of the lifting plate 130 may move in conjunction with the second lifting induction member 142.

The first and second operating members 151 and 152 may be provided to be capable of adjusting the height of at least one of the first end of the lifting plate 130 and the second end of the lifting plate 130. Specifically, the first and second operating members 151 and 152 may include the first operating member 151 coupled to the first lifting induction member 141 to be capable of adjusting the height of the first end of the lifting plate 130 by rotating the first lifting induction member 141, and the second operating member 152 coupled to the second lifting induction member 142 to be capable of adjusting the height of the second end of the lifting plate 130 by rotating the second lifting induction member 142 separately from the first lifting induction member 141.

The first and second operating members 151 and 152 may be rotatably coupled to the lifting induction member 140. That is, the first and second operating members 151 and 152 may be coupled to the lifting induction member 140 to be rotatable about the lifting induction member 140. The first and second operating members 151 and 152 may have the shape of a pivotable lever. However, the shape of the first and second operating members 151 and 152 is not limited to the above example and may be variously changed.

The rack assembly 1000 may further include the roller 180 that is rotatably mounted on the frame 110. The roller 180 may be rotatably mounted on the frame 110 to be movable along the guide rail 290.

As illustrated in FIG. 19*a*, the lifting plate 130 of the rack assembly 1000 may be raised in the height direction H of the dishwasher 1. The lifting plate 130 may be raised up to a position substantially at the same position as the fixing plate 111 of the frame 110 in the height direction H of the dishwasher 1. That is, the opposite ends of the lifting plate 130 may be raised to the same degree in the height direction H of the dishwasher 1.

When the user rotates the first operating member 151 to direct upward, that is, when the user rotates the first operating member 151 to be positioned at the same height as the lifting plate 130, the first lifting induction member 141 rotates integrally with the first operating member 151, and the first end of the lifting plate 130 may be positioned at substantially the same position as the fixing plate 111 of the frame 110 in the height direction H of the dishwasher 1.

When the user rotates the second operating member 152 to direct upward, that is, when the user rotates the second operating member 152 to be positioned at the same height as the lifting plate 130, the second lifting induction member 142 rotates integrally with the second operating member 152, and the second end of the lifting plate 130 may be positioned at substantially the same position as the fixing plate 111 of the frame 110 in the height direction H of the dishwasher 1.

The user may rotate the first operating member 151 and the second operating member 152 simultaneously or sequentially.

As illustrated in FIG. 19*b*, the lifting plate 130 of the rack assembly 1000 may be lowered in the height direction H of the dishwasher 1. The lifting plate 130 may be lowered until the lifting plate 130 is positioned below the fixing plate 111 of the frame 110 in the height direction H of the dishwasher 1. That is, the opposite ends of the lifting plate 130 may be lowered to the same degree in the height direction H of the dishwasher 1. At this time, a step may be formed between the lifting plate 130 and the fixing plate 111.

When the user rotates the first operating member 151 to direct downward, the first lifting induction member 141 rotates integrally with the first operating member 151, and the first end of the lifting plate 130 may be positioned below the fixing plate 111 of the frame 110 in the height direction H of the dishwasher 1.

When the user rotates the second operating member 152 to direct downward, the second lifting induction member 142 rotates integrally with the second operating member 152, and the second end of the lifting plate 130 may be positioned below the fixing plate 111 of the frame 110 in the height direction H of the dishwasher 1.

The user may rotate the first operating member 151 and the second operating member 152 simultaneously or sequentially.

The degree of rotation of the first operating member 151 and the degree of rotation of the second operating member 152 may be the same.

Although not shown, the lifting plate 130 of the rack assembly 1000 may be provided such that the positions of the first end and the second end of the lifting plate 130 are different in the height direction H of the dishwasher 1. That is, the lifting plate 130 of the rack assembly 1000 may be provided to be inclined. As an example, the case where the first end of the lifting plate 130 is raised and the second end of the lifting plate 130 is lowered will be mainly described below.

When the user rotates the first operating member 151 to direct upward, the first lifting induction member 141 rotates integrally with the first operating member 151, and the first end of the lifting plate 130 may be positioned at substantially the same position as the fixing plate 111 of the frame 110 in the height direction H of the dishwasher 1.

When the user rotates the second operating member 152 to direct downward, the second lifting induction member 142 rotates integrally with the second operating member 152, and the second end of the lifting plate 130 may be positioned below the fixing plate 111 of the frame 110 in the height direction H of the dishwasher 1.

The user may rotate the first operating member 151 and the second operating member 152 simultaneously or sequentially.

The rotation direction of the first operating member 151 and the rotation direction of the second operating member 152 may be different from each other.

Figure 20:
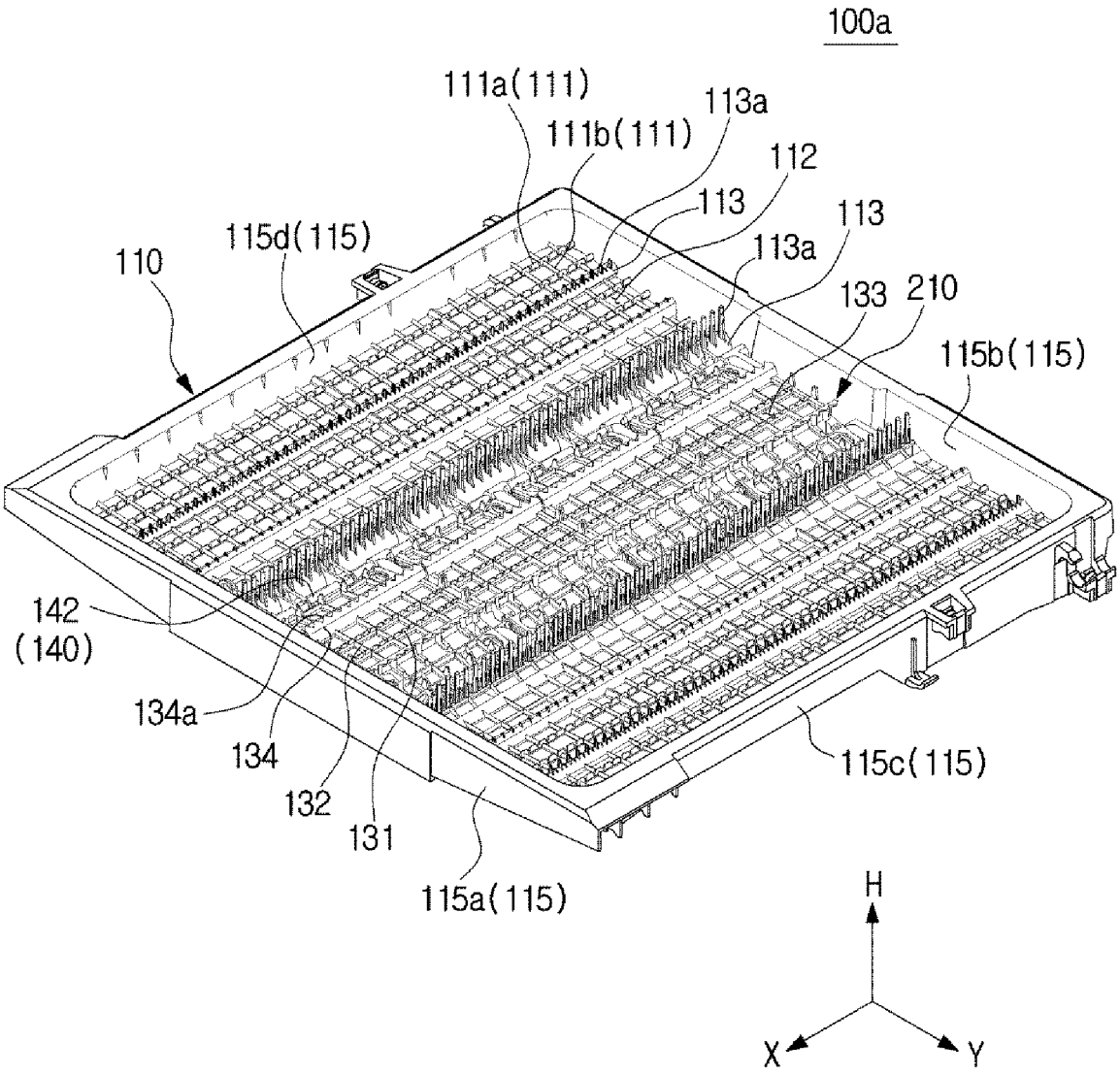
FIG. 20 is a perspective view of a rack assembly in a dishwasher according to an embodiment of the present disclosure.
Figure 21:
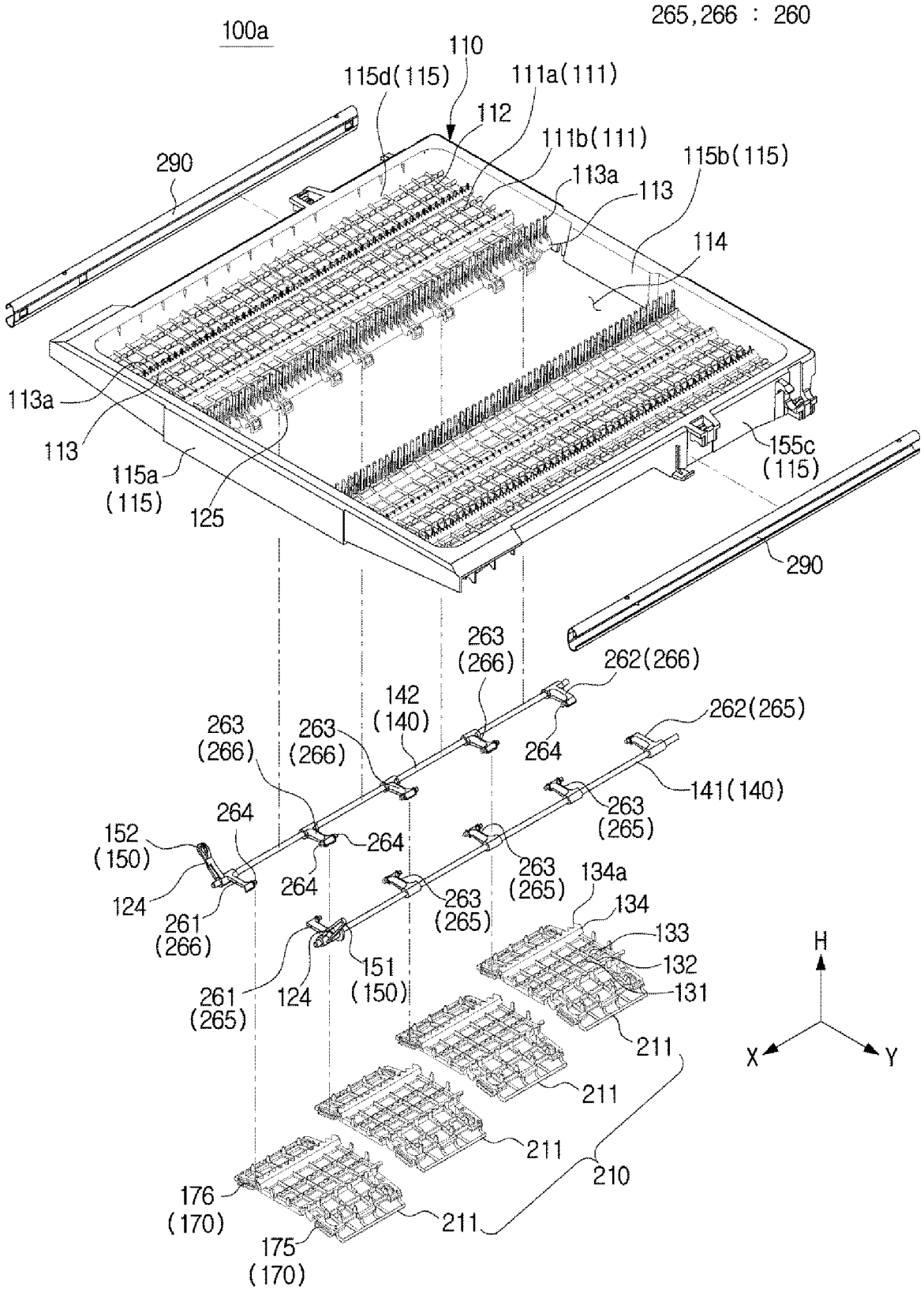
FIG. 21 is an exploded perspective view of a rack assembly in a dishwasher according to an embodiment of the present disclosure.

FIG. 20 is a perspective view of a rack assembly in a dishwasher according to an embodiment of the present disclosure, and FIG. 21 is an exploded perspective view of a rack assembly in a dishwasher according to an embodiment of the present disclosure. Hereinafter, a description overlapping with those described through FIGS. 1 to 13 will be omitted. Hereinafter, the same reference numerals are assigned to the same components as those described with reference to FIGS. 1 to 13.

As illustrated in FIGS. 20 and 21, a rack assembly 100*a* may include the frame 110 forming an outer appearance of the rack assembly 100*a*.

The frame 110 may include the loading portion on which the tableware is placed. The loading portion may include the fixing plate 111 and a lifting plate 210 provided to be movable up and down. The lifting plate 210 may include a plurality of lifting units 211. The plurality of lifting units 211 may be coupled to the lifting induction member 140 in the first direction X. The lifting plate 210 may move in conjunction with the lifting induction member 140. That is, the plurality of lifting units 211 may move in conjunction with the lifting induction member 140.

The rack assembly 100*a* may further include a link member 260 connecting the lifting plate 210 and the lifting induction member 140. A first end of the link member 260 may be coupled to the lifting plate 210, and a second end of the link member 260 may be coupled to the lifting induction member 140. The link member 260 may include an arm 264 formed at the first end of the link member 260 to be movably coupled to the guide slot 170.

The link member 260 may include a plurality of link units 261, 262, and 263 connecting the plurality of lifting units 211 and the lifting induction member 140. A first end of each of the plurality of link units 261, 262, and 263 may be coupled to each of the plurality of lifting units 211, and a second end of each of the plurality of link units 261, 262, and 263 may be coupled to the lifting induction member 140. The plurality of link units 261, 262, and 263 may include the first link unit 261 facing the first wall 115*a* of the frame 110, and the second link unit 262 facing the second wall 115*b* of the frame 110. The first link unit 261 and the second link unit 262 may include the arm 264 formed at the first end of each of the first and second link unit 261 and 262 to be movably coupled to the guide slot 170. The first link unit 261 and the first and second operating members 151 and 152 may be integrally formed. The plurality of link units 261, 262, and 263 may further include the at least one third link unit 263 disposed between the first link unit 261 and the second link unit 262. The at least one third link unit 263 may connect the plurality of neighboring lifting units 211. That is, the at least one third link unit 263 may include a plurality of the arms 264 connecting the third link units 263 so that the plurality of neighboring lifting units 211 may move integrally. The plurality of arms 264 may be formed at the first end of the at least one third link unit 263 coupled to the plurality of lifting units 211. The plurality of arms 264 may be movably coupled to the guide slot 170 formed at the plurality of lifting units 211. Specifically, any one of the plurality of arms 264 may be movably coupled to the guide slot 170 of any one of the plurality of neighboring lifting units 211, and the other one of the plurality of arms 264 may be movably coupled to the guide slot 170 of the other one of the plurality of neighboring lifting units 211.

Each of the plurality of lifting units 211 may include the guide slot 170 provided to correspond to each of the plurality of link units 261, 262, and 263. The arm 264 of each of the plurality of link units 261, 262, and 263 may be movably coupled to the guide slot 170 of each of the plurality of lifting units 211. The guide slot 170 may have a cut shape elongated in the second direction Y.

Each of the plurality of lifting units 211 may include a plurality of the guide slots 170. Specifically, each of the plurality of lifting units 211 may include the guide slot formed at a first surface of the plurality of lifting units 211 facing the first wall 115*a* of the frame 110, and the guide slot formed at a second surface of the plurality of lifting units 211 facing the second wall 115*b* of the frame 110.

The arm 264 formed at the first end of the first link unit 261 may be movably coupled to the guide slot formed at the first surface of the plurality of lifting units 211 facing the first wall 115*a* of the frame 110, and the arm 264 formed at the first end of the second link unit 262 may be movably coupled to the guide slot formed at the second surface of the plurality of lifting units 211 facing the second wall 115*b* of the frame 110. The plurality of arms 264 formed at the first end of the at least one third link unit 263 may be movably coupled to the guide slot formed at the first surface of any one of the plurality of neighboring lifting units 211 and the guide slot formed at the second surface of the other one of the plurality of neighboring lifting units 211, respectively.

The guide slot 170 may include the first end 171 adjacent to the lifting induction member 140 and the second end 172 positioned opposite the first end 171. The second end 172 of the guide slot 170 may be positioned above the first end 171 of the guide slot 170 in the height direction H of the dishwasher 1. The guide slot 170 may further include the connection portion 173 connecting the first end 171 and the second end 172 of the guide slot 170 so that the arm 164 of the plurality of link units 261, 262, and 263 moves together. The connection portion 173 may be flat without bending.

When the arm 264 of the plurality of link units 261, 262, and 263 is positioned at the first end 171 of the guide slot 170, the plurality of lifting units 211 may be lowered in the height direction H of the dishwasher 1. On the contrary, when the arm 264 of the plurality of link units 261, 262 and 263 is positioned at the second end 172 of the guide slot 170, the plurality of lifting units 211 may be raised in the height direction H of the dishwasher 1.

The link member 260 may include a first link member 265 connecting the first end of the plurality of lifting units 211 and the first lifting induction member 141, and a second link member 266 connecting the second end of the plurality of lifting units 211 and the second lifting induction member 142. The arm 264 of the first link member 265 may be movably coupled to the first guide slot 175 provided at the first end of the plurality of lifting units 211. The arm 264 of the second link member 266 may be movably coupled to the second guide slot 176 provided at the second end of the plurality of lifting units 211.

When the user rotates the first and second operating members 151 and 152, the first lifting induction member 141 rotates integrally with the first operating member 151, and the second lifting induction member 142 rotates integrally with the second operating member 152. At this time, the first end of the plurality of lifting units 211 moves in conjunction with the first lifting induction member 141, and the second end of the plurality of lifting units 211 moves in conjunction with the second lifting induction member 142.

FIGS. 20 and 21 illustrate the case where the plurality of lifting units 211 move integrally, but the lifting units 211 may move separately. As an example, some of the plurality of lifting units 211 may be raised while the remainder of the plurality of lifting units 211 are lowered. Further, the directions in which the plurality of lifting units 211 are inclined may be different from each other. As an example, the first end of some of the plurality of lifting units 211 may be lowered while the second end of the remainder of the plurality of lifting units 211 are lowered.

In the above, a method of adjusting the height of the lifting plate by rotating the operating member has been described. However, the height adjusting method of the lifting plate is not limited to the above examples and may be variously changed.

As is apparent from the above, the dishwasher according to the present disclosure can easily adjust the height of a lifting plate without having to withdraw a rack assembly from a tub by a user by positioning an operating member for adjusting the height of the lifting plate to be adjacent to an opening portion of the tub which is easy to access by the user.

Further, because the dishwasher according to the present disclosure can adjust not only the height of a lifting plate, but also the inclination thereof, the dishwasher according to the present disclosure can accommodate tableware having various volumes in a rack assembly and a basket positioned below the rack assembly in comparison with conventional dishwashers. Accordingly, the dishwasher of the present disclosure can be expected to have an effect of improving the space utilization of a tub.

Further, the dishwasher according to the present disclosure can be manufactured with a relatively light rack assembly, simplify the manufacturing process of the rack assembly, and also reduce the manufacturing cost of the rack assembly, by fabricating a frame that forms an outer appearance of the rack assembly using only plastic materials instead of using metal wires.

The embodiments disclosed with reference to the accompanying drawings have been described above. It will be understood by those skilled in the art that various changes in form and details may be made therein without departing from the spirit and scope of the present disclosure as defined by the appended claims. The disclosed embodiments are illustrative and should not be construed as limiting.

What is claimed is:

1. A dishwasher comprising:
a main body;
a tub disposed inside the main body and having an opening;
a door to open or close the opening of the tub; and
a rack assembly disposed inside the tub,
wherein the rack assembly includes:
a fixing plate to accommodate tableware;
a lifting plate movable up and down relative to the fixing plate to adjust a height of the lifting plate in the tub, the lifting plate to accommodate tableware;
an operating lever to move the lifting plate; and
a lifting induction connector to connect the operating lever to the lifting plate, so that an operation of the operating lever moves the lifting induction connector, which thereby moves the lifting plate up and down relative to the fixing plate,
wherein the lifting induction connector is rotatable relative to the fixing plate and the lifting plate.

2. The dishwasher according to claim 1, wherein:
the rack assembly further includes a link connector to connect the lifting plate to the lifting induction connector.

3. The dishwasher according to claim 2, wherein:
the link connector includes an arm, and
the lifting plate includes a guide slot movably coupled to the arm of the link connector.

4. The dishwasher according to claim 3, wherein:
the guide slot includes a first end adjacent to the lifting induction connector, and a second end positioned opposite the first end and above the first end.

5. The dishwasher according to claim 4, wherein:
the guide slot further includes a connection portion connecting the first end to the second end.

6. The dishwasher according to claim 4, wherein:
when the arm of the link connector is positioned at the first end of the guide slot, the lifting plate is lowered, and
when the arm of the link connector is positioned at the second end of the guide slot, the lifting plate is raised.

7. The dishwasher according to claim 1, wherein:
the rack assembly further includes a lifting induction connector holder extending from the fixing plate toward the lifting plate to be coupled with the lifting induction connector.

8. The dishwasher according to claim 1, wherein:
the operating lever is coupled to the lifting induction connector to rotate with the lifting induction connector.

9. The dishwasher according to claim 8, wherein:
the rack assembly further includes a rotation restricting rib to restrict a rotation range of the operating lever.

10. The dishwasher according to claim 9, wherein:
the rotation restricting rib includes:
a first rotation restricting rib to interfere with the operating lever when the lifting plate is raised; and
a second rotation restricting rib to interfere with the operating lever when the lifting plate is lowered, and spaced apart from the first rotation restricting rib.

11. A dishwasher comprising:
a main body;
a tub disposed inside the main body; and
a rack assembly disposed inside the tub,
wherein the rack assembly includes:
a fixing plate to accommodate tableware;
a lifting plate movable up and down relative to the fixing plate to adjust a height of the lifting plate in the tub to accommodate tableware;
a first lifting induction connector rotatably connected to a first end of the lifting plate;
a second lifting induction connector rotatably connected to a second end of the lifting plate; and
an operating lever to rotate at least one of the first lifting induction connector and the second lifting induction connector to move at least one of the first end of the lifting plate and the second end of the lifting plate, respectively.

12. The dishwasher according to claim 11, wherein:
the tub includes an opening, and the operating lever is adjacent to the opening of the tub.

13. The dishwasher according to claim 12, wherein:
the operating lever includes:
a first operating lever coupled to the first lifting induction connector to move the first end of the lifting plate by rotating the first lifting induction connector; and
a second operating lever coupled to the second lifting induction connector to move the second end of the lifting plate by rotating the second lifting induction connector separately from the first operating lever.

14. The dishwasher according to claim 11, wherein:

the rack assembly further includes:

a first link connector to connect the first end of the lifting plate to the first lifting induction connector, and having an arm movably coupled to a first guide slot provided at the first end of the lifting plate; and a second link connector to connect the second end of the lifting plate to the second lifting induction connector, and having an arm movably coupled to a second guide slot provided at the second end of the lifting plate.

15. A dishwasher comprising:

a main body;

a tub disposed inside the main body and having an opening; and a rack assembly disposed inside the tub to be capable of being withdrawn, wherein the rack assembly includes:

a fixing plate to accommodate tableware;

a lifting plate movable up and down relative to the fixing plate to adjust a height of the lifting plate in the tub to accommodate tableware;

a lifting induction connector rotatably connected to the lifting plate; and an operating lever provided adjacent to an opening of the tub to operate to move the lifting induction connector to thereby move the lifting plate while the rack assembly is positioned inside the tub.

16. The dishwasher according to claim 15, wherein the lifting plate is movable up and down among:

a first state where a first end of the lifting plate is raised and a second end of the lifting plate is raised, a second state where the first end of the lifting plate is raised and the second end of the lifting plate is lowered, and a third state where the first end of the lifting plate is lowered and the second end of the lifting plate is lowered.

* * * * *